United States Patent [19]

Boyd et al.

[11] Patent Number: 4,691,694

[45] **Date of Patent: * Sep. 8, 1987**

[54] MUSCLE EXERCISE AND REHABILITATION APPARATUS

[75] Inventors: Robert L. Boyd, Woodcliff Lake; Richard Krukowski, Chatham, both of N.J.; Daniel Y. Gezari, Chevy Chase, Md.

[73] Assignee: Biodex Corporation, Shirley, N.Y.

[ * ] Notice: The portion of the term of this patent subsequent to Feb. 16, 2003 has been disclaimed.

[21] Appl. No.: 907,392

[22] Filed: Sep. 15, 1986

Related U.S. Application Data

[63] Continuation-in-part of Ser. No. 676,493, Nov. 29, 1984, Pat. No. 4,628,910.

[51] Int. Cl.[4] ..... A63B 23/00

[52] U.S. Cl. ..... 128/25 R; 272/129; 272/DIG. 6

[58] Field of Search ..... 128/25 R, 256, 26, 363, 128/364; 272/129, 130, 116, DIG. 5, DIG. 6

[56] References Cited

U.S. PATENT DOCUMENTS

| | | | |
|---|---|---|---|
| 2,784,591 | 3/1957 | Shoor . | |
| 3,301,553 | 1/1967 | Brakeman . | |
| 3,374,675 | 3/1968 | Keropian . | |
| 3,465,592 | 11/1969 | Perrine . | |
| 3,505,992 | 4/1970 | Jaeger . | |
| 3,511,097 | 5/1970 | Corwin . | |
| 3,580,244 | 5/1971 | Graves . | |
| 3,705,721 | 12/1972 | Lulay et al. . | |
| 3,744,480 | 7/1973 | Gause et al. | 272/129 |
| 3,767,195 | 10/1973 | Dimick . | |
| 3,784,194 | 1/1974 | Perrine . | |
| 3,822,599 | 7/1974 | Brentham . | |
| 3,848,467 | 11/1974 | Flavell | 272/129 |
| 3,859,840 | 1/1975 | Gause . | |
| 3,869,121 | 3/1975 | Flavell | 272/129 |
| 3,902,480 | 9/1975 | Wilson . | |
| 4,184,678 | 1/1980 | Flavell | 272/DIG. 6 |
| 4,235,437 | 11/1980 | Ruis et al. . | |
| 4,326,707 | 4/1982 | Strecker . | |
| 4,333,340 | 6/1982 | Elmeskog | 73/379 |
| 4,337,050 | 6/1982 | Engalitcheff, Jr. . | |
| 4,354,676 | 10/1982 | Ariel . | |
| 4,407,496 | 10/1983 | Johnson | 244/52 |
| 4,479,647 | 10/1984 | Smith . | |
| 4,492,222 | 1/1985 | Hajianpour . | |
| 4,544,154 | 10/1985 | Ariel . | |
| 4,549,534 | 10/1985 | Zagorski et al. . | |
| 4,601,468 | 7/1986 | Bond et al. . | |

*Primary Examiner*—Leo P. Picard

*Attorney, Agent, or Firm*—Cobrin & Godsberg

[57] ABSTRACT

A muscle exercise and rahabilitation apparatus includes a movable fixture against which a force can be applied; a servo motor having an output shaft coupled to the fixture; a strain gauge effectively coupled between the output shaft and the fixture for producing a load signal corresponding to the force applied to the fixture; a speed detector for producing a velocity signal corresponding to the speed of the fixture; a closed loop servo circuit for controlling the motor in response to the load and velocity signals to regulate the velocity of the fixture; a limit circuit for preventing movement of the fixture past opposite limits; a storage circuit for storing limit signals corresponding to each limit; a limit setting circuit for enabling the storage circuit to store each limit upon movement of the fixture thereto; a position sensing circuit for producing a position signal corresponding to the position of the fixture; a deceleration circuit for slowing down movement of the fixture as the fixture approaches each limit, in response to the velocity, position and limit signals; detecting circuits for detecting a plurality of predetermined operational faults of the apparatus; an emergency stop circuit for terminating operation of the apparatus upon detection of some of the operation faults; a dynamic brake for braking the servo motor to stop movement of the fixture in response to the emergency stop circuit; and a stop circuit for controlling the motor to stop movement of the fixture upon detection of other operation faults.

56 Claims, 20 Drawing Figures

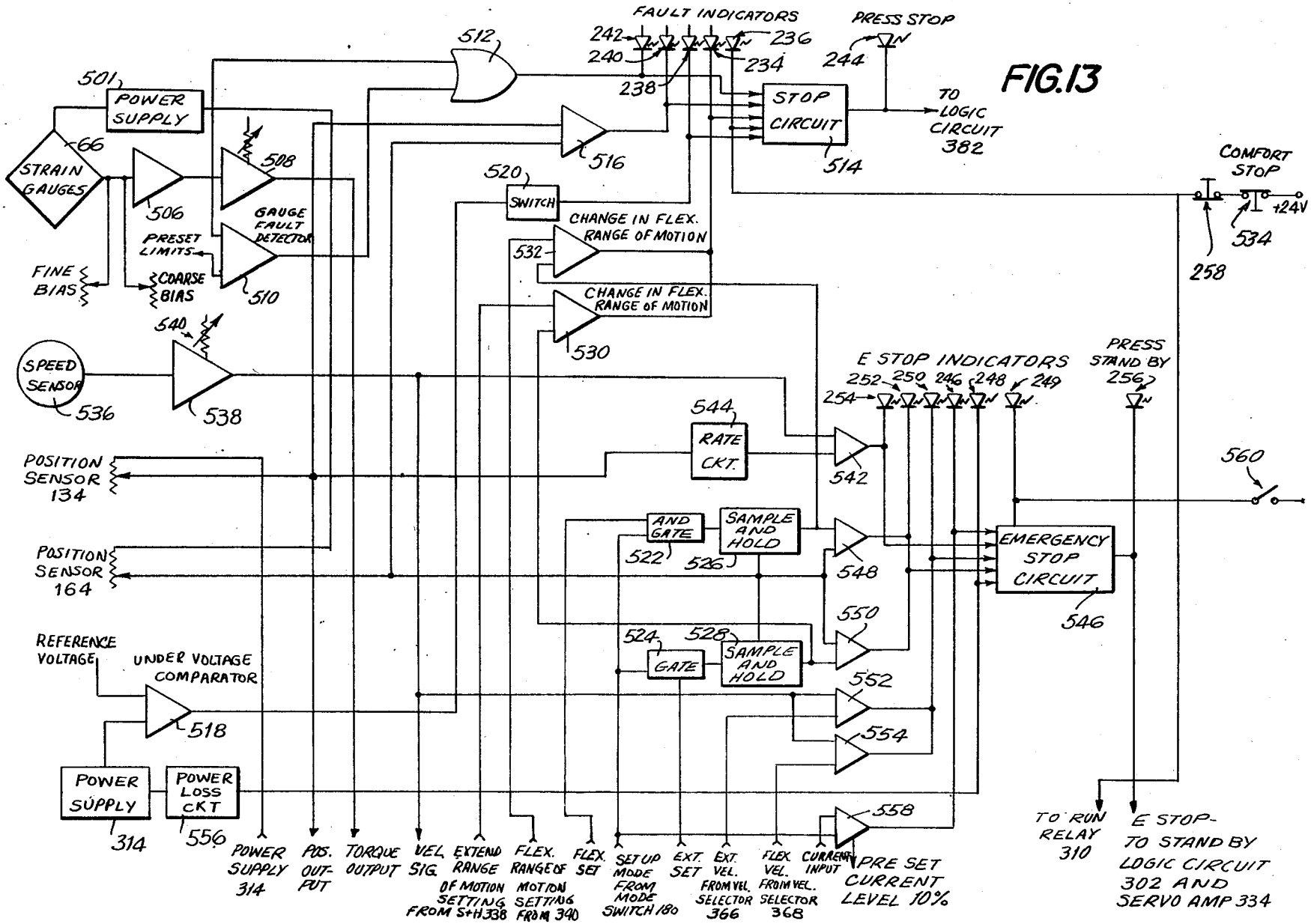
FIG.13
COMFORT STOP
+24V
534
258
560
PRESS STAND BY 256
E STOP-TO STAND BY LOGIC CIRCUIT 302 AND SERVO AMP 334
TO RUN RELAY 310
EMERGENCY STOP CIRCUIT
546
E STOP INDICATORS
249
248
246
250
252
254
PRESS STOP
244
TO LOGIC CIRCUIT 382
STOP CIRCUIT
514
FAULT INDICATORS
236
234
238
242
240
542
548
550
552
554
558
PRE SET CURRENT LEVEL 10%
CURRENT INPUT
FLEX. VEL. FROM VEL. SELECTOR 368
EXT. VEL. FROM VEL. SELECTOR 366
EXT. SET
SET UP MODE FROM MODE SWITCH 180
FLEX. SET
FLEX. RANGE OF MOTION SETTING FROM 340
VEL. EXTEND RANGE OF MOTION SETTING FROM S+H 338
TORQUE OUTPUT SIG.
POS. OUT-PUT
POWER SUPPLY 314
SAMPLE AND HOLD
526
SAMPLE AND HOLD
528
RATE CKT.
544
AND GATE
522
GATE
524
CHANGE IN FLEX. RANGE OF MOTION
CHANGE IN FLEX. RANGE OF MOTION
530
516
512
SWITCH
520
532
508
GAUGE FAULT DETECTOR
510
538
540
506
PRESET LIMITS
COARSE BIAS
POWER SUPPLY
501
66
STRAIN GAUGES
FINE BIAS
SPEED SENSOR
536
POSITION SENSOR 134
POSITION SENSOR 164
REFERENCE VOLTAGE
UNDER VOLTAGE COMPARATOR
518
POWER LOSS CKT
556
POWER SUPPLY
314

| FIG. 14A | FIG. 14B |
| --- | --- |
| FIG. 14C | FIG. 14D |

MUSCLE EXERCISE AND REHABILITATION APPARATUS

REFERENCE TO RELATED APPLICATION

The present application is a continuation-in-part of commonly assigned, copending U.S. patent application Ser. No. 676,493, filed Nov. 29, 1984, now U.S. Pat. No. 4,628,910, entitled Muscle Exercise and Rehabilitation Apparatus, by Richard Krukowski.

BACKGROUND OF THE INVENTION

This invention relates generally to exercise and rehabilitation apparatus and, more particularly, is directed to exercise and rehabilitation apparatus operative in isokinetic (voluntary) and passive (oscillation) modes.

Various exercising machines, such as those designated by 'Universal', 'Nautilus', 'Cybex' and 'Kin/-Com', are well known in the art.

One of the first of these machines was the 'Universal' exercising machine which uses a pulley-weight system, whereby the weights added to the pulley system can be varied by the user. With such apparatus, however, there are no controls over the manner, that is, the speed of movement and the torque applied by the user, in overcoming the weight load. It is only necessary that the user apply a force that is greater than the weight load through the pulley system. As such, the 'Universal' apparatus is similar to a free weight system.

The 'Nautilus' apparatus was developed to overcome some of the deficiencies of the 'Universal' machine by providing a fixed path of movement of the respective arms thereof so that the latter follow respective paths designed for better muscle isolation during exercise. The 'Nautilus' apparatus, rather than using a pulley-weight system, uses a novel cam arrangement. However, as with the 'Universal' machine, the 'Nautilus' apparatus does not control the speed of movement or resistive torque applied to the arm.

The 'Cybex' apparatus, as exemplified in U.S. Pat. No. 3,465,592, recognized that the muscle is not equally powerful throughout its entire range of motion. The 'Cybex' apparatus provides a motor connected through a gearing system to regulate the exercise arm of the machine so that it travels with a constant velocity, thereby taking into account the different strengths of the muscle during different angular extensions thereof.

Although the 'Cybex' apparatus provides distinct advantages over the aforementioned 'Universal' and 'Nautilus' apparatus, the 'Cybex' apparatus fails to provide necessary functions for truly accurate and corrective exercise and rehabilitation. In this regard, the 'Cybex' apparatus uses a motor with two clutches. The arm of the apparatus is movable freely until the planetary speed of the gearing therein is reached, whereupon an impact resistive force is met by the user. This impact resistive force, of course, is undesirable, particularly from a rehabilitation standpoint.

Further, with the 'Cybex' apparatus, although a constant velocity operation is provided for both extension and flexion of a muscle, there is no provision for controlled movement for both concentric and eccentric motions. The 'Cybex' apparatus also only provides for voluntary constant velocity motions for a portion of its range of movement.

U.S. Pat. No, 4,235,437 discloses a robotic exercise machine which uses a computer to regulate the motion of an exercise arm in response to software programmed into the machine and in response to the force applied to the arm by the user as detected by a strain gauge at the end of the arm. By means of hydraulic cylinders and solenoid controlled valves, movement of the arm can be accurately controlled. However, the equipment provided in U.S. Pat. No. 4,235,437 is relatively complicated and requires expensive computer equipment and a complex linkage system. Further, because the equipment is computer controlled, the user must spend some time programming the computer with the desired settings before exercising. This, of course, is time consuming and detracts from the exercising.

It is to be appreciated that, with muscle exercise and rehabilitation apparatus, it is necessary that movement of the arm be smooth in all modes of operation. A problem with computer controlled apparatus is that the computer must make various samplings and computations, and thereafter makes corrections that are necessary. Although computer time is generally considered fast, the amount of time necessary for the computer to perform such operations and then control the mechanical and hydraulic devices of the apparatus may not result in smooth movement of the exercise arm, particularly at small loads.

There is also known a muscle exercise and rehabilitation apparatus sold by Chattecx Corporation of Chattanooga, Tenn. under the name 'Kin/Com' which provides a computer controlled hydraulic system that monitors and measures velocities, angles and forces during muscular contractions. A load cell is provided to measure the force at the point of application, with an accuracy of 4 ounces. However, this apparatus, being computer controlled, suffers from the same problems discussed above with respect to U.S. Pat. No. 4,235,437.

U.S. Pat. No. 3,744,480 discloses an ergometer having a pedal driven DC motor as a load, including a frame for supporting the body of a person, whereby the pedals may be operated by either the feet or hands, and the electrical circuitry of the ergometer limits the load applied to the pedals as a function of work being performed, heart rate and increases in heart rate. However, with this Patent, the motor is used as a brake to provide a dynamic braking action. The problem with dynamic braking, that is, where there is a resistive load across the armature of the motor and the motor acts as a generator, is that such dynamic braking is not a linear function. As a result, it is difficult to accurately control the movement of the arm. Further, the range of operation with dynamic braking is limited. For example, dynamic braking can not be attained with a set velocity of 10 degrees/second in the 300–400 foot-pound range.

U.S. Pat. Nos. 3,848,467 and 3,869,121 each disclose an exercise machine in which a user applies a force to an arm which is coupled to a drive shaft, the latter being driven by a servo motor through a speed reducer. A brake is connected to the servo motor through the speed reducer, although in the embodiment of FIG. 3, a permanent magnet servo motor is used as both the powering means and the brake. A speed and direction sensor is connected with the drive shaft, the servo motor or the speed reducer, and supplies a signal to a comparator, corresponding the direction and speed of the arm. Another input of the comparator is supplied with a signal from a speed and direction programmer, corresponding to a desired speed and direction of movement of the arm. The comparator controls the powering means and the brake in response to these signals to regulate the system speed, responsive to varying exercises force applied to the arm during both concentric and eccentric muscular contractions.

With these latter Patents, however, the servo motor does not drive the arm for concentric muscular contractions, but only functions as a brake at such time, although it drives the arm for eccentric muscular contractions. Specifically, when the user grasps the exercise arm or bar, for example, during an arm curl operation, he first applies a force to move the bar to shoulder height, applying concentric muscular contractions, that is, where the bar is caused to move in the same direction that the force is applied. At this time, it is the user's force that moves the bar, and not the servo motor. As this force is applied, the servo motor functions as a generator. When the force is sufficient to cause rotation at a predetermined clamp velocity, a shunt element is connected in the circuit, to apply a dynamic braking force in opposition to and in proportion to the force applied by the user. The downward movement is performed by the servo motor. It is therefore clear that apparatus of this Patent suffers from the same problems aforementioned when the servo motor is used as a brake.

U.S. Pat. No. 4,184,678, although somewhat more sophisticated than the above two Patents, operates in the same general manner.

In order to overcome the above problems with the prior art, there is disclosed in copending U.S. patent application Ser. No. 676,493, filed Nov. 29, 1984, the entire disclosure of which is incorporated herein by reference, a muscle exercise and rehabilitation apparatus in which the servo motor is used to move the arm at all times.

Specifically, as disclosed therein, in the concentric isokinetic mode of operation, the arm is controlled to move with a regulated velocity in the direction of force applied by the user, for both flexion (bending) and extension (unbending) of the limb. For example, in a knee extension/flexion operation, where a cuff at the end of the arm is brought from a vertical to a horizontal position of the user, the servo motor which controls movement of the arm, is driven at a velocity dependent upon the force applied by the user, and in the same direction as the applied force, until a predetermined clamp velocity is reached. Once the predetermined clamp or set velocity is reached, the servo motor drives the arm at a predetermined constant velocity, whereby the arm moves with a constant velocity in the direction of force applied by the user. Thus, if the force applied by the user is too great, that is, will normally drive the arm at a velocity greater than the clamp velocity, the servo motor only drives and/or allows the arm to move at the predetermined clamp velocity. If the user stops applying the force, the arm will stop moving.

During the return movement, where the cuff is brought from the horizontal position to the lower vertical position, during flexion, the user must apply a force in the downward direction in order for the cuff to be moved downwardly. The servo motor moves the arm and the cuff, initially at a velocity dependent upon the downward force applied by the user. Once the velocity reaches a predetermined clamp velocity, the servo motor drives the arm at the predetermined velocity, whereby the arm moves with a constant velocity in the direction of force applied by the user. As with extension, if the user stops applying the force, the arm will cease moving with a constant velocity and come to a full stop.

Thus, with such apparatus, for flexion and extension, the servo motor drives the arm. The user does not move the arm but merely provides a measured force by which the servo motor is controlled.

In the eccentric isokinetic mode of operation, the arm is controlled to move with a regulated velocity in the direction opposite to the direction of force applied by the user, for both flexion and extension of the limb. In one embodiment, the range of speeds is much smaller than that in the concentric isokinetic mode in order to prevent harm to the user. However, again, for both flexion and extension, the servo motor drives the arm.

In the passive or oscillation mode, the arm is caused to oscillate by the servo motor at a constant speed, regardless of the force applied by the user. If there is a force applied by the user, regardless of the direction of such force (either concentric or eccentric), which would cause the arm to change its speed of oscillation, the servo motor controls the arm to maintain the constant speed.

In all of the above modes, it is the servo motor which moves the arm in response to the sensed velocity and/or predetermined force applied to the arm. The user does not move the arm. Because the servo motor is used to move the arm at all times, movement of the arm can be linearly controlled in response to the force applied thereto for forces within the range of 0–400 foot-pounds.

With such apparatus, circuitry is provided for limiting the angular range of motion of the arm. Specifically, for each direction, an amplifier receives a signal from a position sensor corresponding to the angular position, and a signal from a potentiometer corresponding to a preset angular limit. When the angular limit is reached, the amplifier provides an appropriate signal to a PWM amplifier which, in turn, controls the servo motor to prevent the arm from exceeding its set angular limit. The voltage across each potentiometer is set by a knob which the user adjusts to attain a desired angular limit. However, adjustment by such knobs is by a trial and error method, that is, the knobs are set and the user operates the apparatus. If the settings are incorrect, the knobs must be reset. Therefore, such adjustments may pose a danger to the user if the limits are initially adjusted for an excessive angular limit.

In the aforementioned copending U.S. patent application Ser. No. 676,493, a strain gauge is mounted on the arm and produces an output signal indicative of the load, which is used in the closed loop velocity servo system to regulate the angular speed of the arm. This is disadvantageous for the reason that, if different arms or arms are used for different purposes, each time that a different arm is used, the strain gauge would also have to be changed. This, of course, also requires that appropriate wires from each arm be reattached to the amplifier of the apparatus during each change.

The problems of sensitivity and vibration, however, are not limited to the mounting of the strain gauge on the arm. For example, due to inaccuracies in tolerances between connections of various mechanical elements, such as between the gear reducer and motor shaft, and between the arm and the gear reducer, leading to a looseness or backlash between such elements, causing servo instability which is inherently a problem with high gain systems. When this backlash is servoed through the controlled loop velocity servo system, inaccuracies in control of the arm result. Accordingly, it becomes virtually impossible to obtain stable large angular velocities, such as 450 degrees/second.

Still further, because of such backlash and decreased sensitivity, whereby large angular velocities can not be achieved, when it is attempted to, for example, kick at 450 degrees/second, the machine effectively prevents such angular speed. This may result in inaccurate or false readings from a monitor or the like, making it difficult to diagnose a problem of the user.

It will be realized that, in an apparatus which controls movement of the limb of a user by means of a servo motor, various errors in operation may occur, which may be dangerous and harmful to the user. It is therefore desirable to provide various safety features to overcome such contingent situations.

OBJECTS AND SUMMARY OF THE INVENTION

Accordingly, it is an object of the present invention to provide a muscle exercise and rehabilitation apparatus that overcomes the aforementioned problems.

It is another object of the present invention to provide a muscle exercise and rehabilitation apparatus in which the fixture is moved at all times by the servo motor in response to the sensed or predetermined velocity of the fixture and the force applied thereto.

It is still another object of the present invention to provide a muscle exercise and rehabilitation apparatus in which the angular range of motion of the fixture can be easily and readily set by having the user move his limb to the desired limit of his range of motion and depressing a set button.

It is yet another object of the present invention to provide a muscle exercise and rehabilitation apparatus in which deceleration of the fixture near an angular limit changes in accordance with the speed of the fixture and the position of the fixture with respect to the angular limit, to provide a gentle cushioning effect and to ensure that the fixture stops precisely at the set limit.

It is a further object of the present invention to provide a muscle exercise and rehabilitation apparatus in which the strain gauge is mounted on the output shaft, rather than the fixture, to provide easy and ready interchangeability of different fixtures.

It is a still further object of the present invention to provide a muscle exercise and rehabilitation apparatus in which external wires connected to the strain gauge mounted on the output shaft are connected in a novel manner so as not to interfere with operation of the machine, even when the machine is used in different angular orientations.

It is a yet further object of the present invention to provide a muscle exercise and rehabilitation apparatus in which mounting of the strain gauge on the output shaft will substantially eliminate the effect of different length fixtures on the strain gauge and eliminate balancing and recalibration due to different gauges.

It is another object of the present invention to provide a muscle exercise and rehabilitation apparatus in which looseness between connections of various mechanical elements is decreased.

It is still another object of the present invention to provide a muscle exercise and rehabilitation apparatus in which backlash is reduced.

It is yet another object of the present invention to provide a muscle exercise and rehabilitation apparatus in which sensitivity and accuracy of the apparatus is increased.

It is a further object of the present invention to provide a muscle exercise and rehabilitation apparatus having numerous and redundant safety features to protect the user from injury.

It is a still further object of the present invention to provide a muscle exercise and rehabilitation apparatus that provides visual diagnostic indicators which indicate the exact sub-system failure of the machine.

It is a yet further object of the present invention to provide a muscle exercise and rehabilitation apparatus that operates in a concentric isokinetic, eccentric isokinetec, passive (oscillation), isometric or set-up mode.

It is another object of the present invention to provide a variable pause of the fixture at its limits during one mode of operation.

In accordance with an aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop velocity servo feedback means for controlling the motor means in response to the load signal and the velocity signal to regulate the velocity of the fixture means; limit means for preventing movement of the fixture means past at least one set limit; storage means for storing a limit signal corresponding to each limit; and limit setting means for enabling the storage means to store the respective limit upon movement of the fixture means to each limit.

In accordance with another aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop velocity servo feedback means for controlling the motor means in resonse to the load signal and the velocity signal to regulate the velocity of the fixture means; limit means for preventing movement of the fixture means past at least one set limit; storage means for storing a limit signal corresponding to each limit; position sensing means for producing a position signal corresponding to the position of the fixture means; and deceleration means for slowing down movement of the fixture means as the fixture means approaches each limit, in response to the velocity signal, the position signal and the limit signal.

In accordance with still another aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop velocity servo feedback means for controlling the motor means in response to the load signal and the velocity signal to regulate the velocity of the fixture means, the closed loop velocity servo feedback means including servo amplifier means for controlling operation of the servo motor means, velocity comparator means for comparing the velocity signal with the load signal and for controlling the servo amplifier in response thereto, and switch means for supplying the load signal to the velocity comparator means; and mode switch means for controlling the switch means in an isometric mode to prevent the load signal being supplied to the velocity comparator means, whereby the fixture means is prevented from moving, regardless of the force applied thereto.

In accordance with yet another aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop velocity servo feedback means for controlling the motor means to drive the fixture means in an oscillation mode at a constant velocity in response to the load signal and the velocity signal to regulate the velocity of the fixture means; limit means for preventing movement of the fixture means past set limits in opposite directions; and pause means for controlling the closed loop velocity servo feedback means to cause the fixture means to pause at each limit for a predetermined amount of time.

In accordance with a further aspect of the present invention, a muscle exercise and rehabilitation apparatus includes movable fixture means against which a force can be applied; servo motor means having an output shaft coupled to the fixture means; sensing means effectively coupled between the output shaft and the fixture means for sensing the force applied to the fixture means and for producing a load signal corresponding thereto; speed detecting means for producing a velocity signal corresponding to the speed of the fixture means; and closed loop velocity servo feedback means for controlling the motor means in response to the load signal and the velocity signal to regulate the velocity of the fixture means.

In accordance with a still further aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop velocity servo feedback means for controlling the motor means in response to the load signal and the velocity signal to regulate the velocity of the fixture means; detection means for detecting at least one predetermined operational fault of the apparatus; emergency stop means for terminating operation of the apparatus upon detection of at least one operation fault; and brake means for braking the servo motor means to stop movement of the fixture means in response to the emergency stop means.

In accordance with a yet further aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop velocity servo feedback means for controlling the motor means in response to the load signal and the velocity signal to regulate the velocity of the fixture means; detection means for detecting at least one predetermined operational fault of the apparatus; and stop means for controlling the servo motor means to stop movement of the fixture means upon detection of at least one operation fault.

In accordance with another aspect of the present invention, a muscle exercise and rehabilitation apparatus includes movable fixture means against a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop servo motor means for controlling the motor means in response to the load signal and the velocity signal to regulate the velocity of the fixture means; a rotatable shaft to which the fixture means is fixed, mounted in the apparatus, at least one end of the rotatable shaft being tapered and having first securing means thereat; the fixture means includes a wedge-shaped tapered bore through which each tapered end of the rotatable shaft can extend; and second securing means for engaging with the first securing means when the fixture means is positioned on one end of the rotatable shaft to fixedly retain the fixture means on the rotatable shaft in a wedge-like manner so as to substantially reduce backlash.

In accordance with still another aspect of the present invention, a muscle exercise and rehabilitation apparatus includes movable fixture means against which a force can be applied; servo motor means coupled to the fixture means; sensing means for sensing the force applied to the fixture means and for producing a load signal corresponding thereto; speed detecting means for producing a velocity signal corresponding to the speed of the fixture means; closed loop servo means for controlling the motor means in response to the load signal and the velocity signal to regulate the velocity of the fixture means; at least one manually operated comfort stop actuator for stopping movement of the fixture means; and stop means for controlling the servo motor means to stop movement of the fixture means in response to the at least one manually operated comfort stop actuator.

In accordance with yet another aspect of the present invention, a muscle exercise and rehabilitation apparatus includes movable fixture means against which a force can be applied; a rotatable shaft to which the fixture means is fixed, mounted in the apparatus, at least one end of the rotatable shaft being tapered and having first securing means thereat; the fixture means includes a wedge-shaped tapered bore through which each tapered end of the rotatable shaft can extend; second securing means for engaging with the first securing means when the fixture means is positioned on one end of the rotatable shaft to fixedly retain the fixture means on the rotatable shaft in a wedge-like manner so as to substantially reduce backlash; servo motor means having an output shaft coupled to the fixture means; sensing means effectively coupled between the output shaft and the fixture means for sensing the force applied to the fixture means and for producing a load signal corresponding thereto; speed detecting means for producing a velocity signal corresponding to the speed of the fixture means; closed loop servo means for controlling the motor means in response to the load signal and the velocity signal to regulate the velocity of the fixture means, the closed loop servo means including servo amplifier means for controlling operation of the servo motor means, velocity comparator means for comparing the velocity signal with the load signal and for controlling the servo amplifier in rsponse thereto, and switch means for supplying the load signal to the velocity comparator means; limit means for preventing movement of the fixture means past at least one set limit; storage means for storing a limit signal corresponding to each the limit; limit setting means for enabling the storage means to store the respective limit upon movement of the fixture means to each limit; position sensing means for producing a position signal corresponding to the position of the fixture means; deceleration means for slowing down movement of the fixture means as the fixture means approaches each limit, in response to the velocity signal, the position signal and the limit signal; pauses means for controlling the closed loop velocity servo feedback means to cause the fixture means to pause at each limit for a predetermined amount of time; mode switch means for controlling the switch means in an isometric mode to prevent the load signal being supplied to the velocity comparator means, whereby the fixture means is prevented from moving, regardless of the force applied thereto, an isokinetic mode in which the fixture means is caused to move with a regulated velocity and an oscillation mode in which the fixture means is caused to oscillate at a constant velocity; detection means for detecting at least one predetermined operational fault of the apparatus; at least one manually operated comfort stop actuator for stopping movement of the fixture means; emergency stop means for terminating operation of the apparatus upon detection of at least one of a predetermined set of the operation faults; brake means for braking the servo motor means to stop movement of the fixture means in response to the emergency stop means; and stop means for controlling the servo motor means to stop movement of the fixture means upon detection of at least one operation fault and in response to the comfort stop actuator.

The above and other objects, features and advantages of the present invention will become readily apparent from the following detailed description, which is to be read in connection with the accompanying drawings.

BRIEF DESCRIPTION OF THE DRAWINGS

FIG. 13 is a block diagram of the safety circuit of the muscle exercise and rehabilitation apparatus of FIG. 1.

DETAILED DESCRIPTION OF A PREFERRED EMBODIMENT

Figure 1:
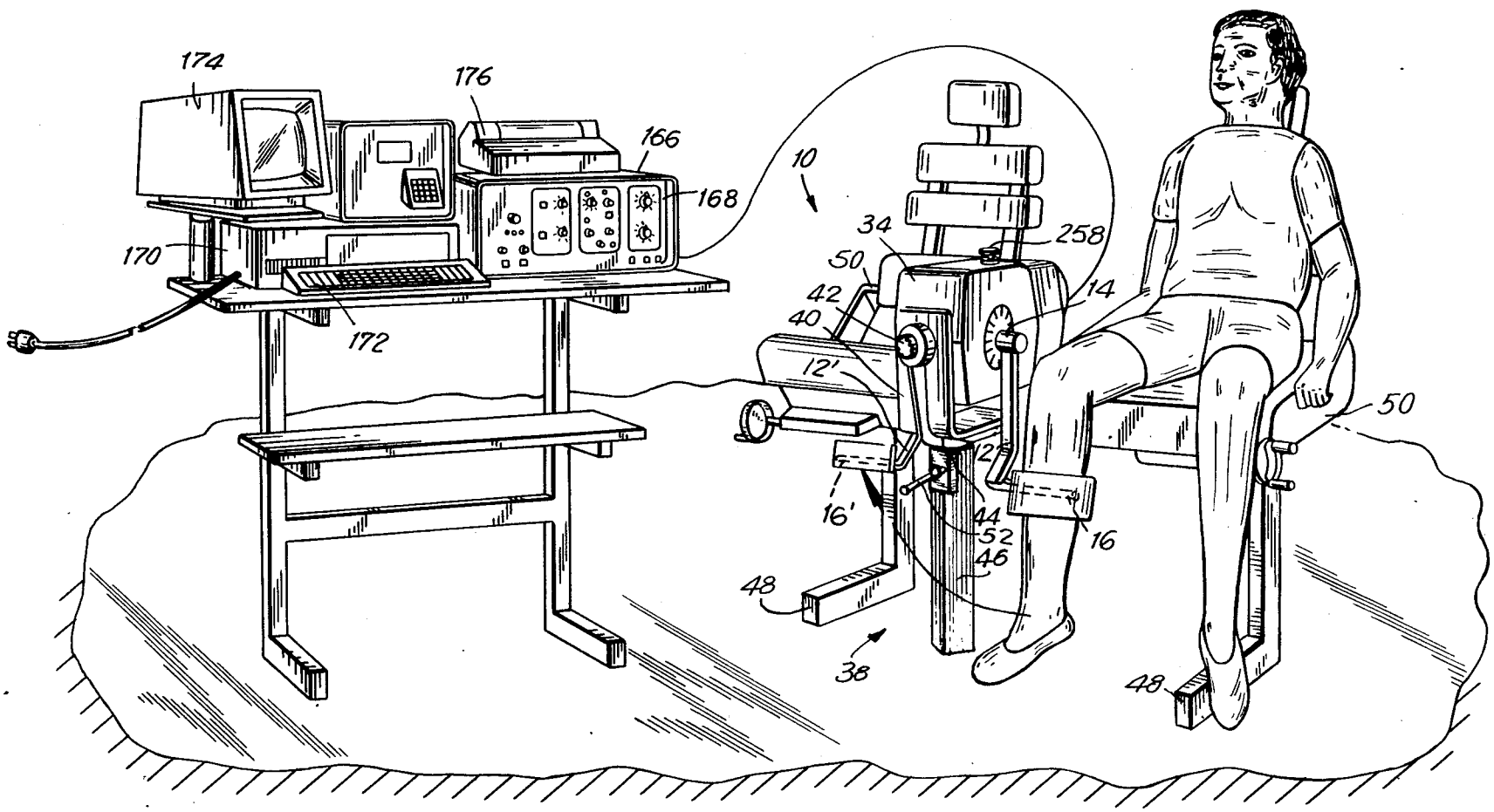
FIG. 1 is a perspective view of muscle exercise and rehabilitation apparatus according to one embodiment of the present invention, along with the control circuit and peripheral apparatus therefor.

Referring to the drawings in detail, and initially to FIG. 1 thereof, a muscle exercise and rehabilitation apparatus 10 according to one embodiment of the present invention includes an fixture 12 having a proximal end secured to a shaft 14 and a distal or free end having a handle 16 to which the use applies a force for muscle exercise and/or rehabilitation.

It will be appreciated that, although only one fixture 12 is shown, the present invention envisions the use of any of a plurality of fixtures of differing configurations and lengths, for exercising and rehabilitating different limbs of the user and/or for exercising and rehabilitation the same limb of the user in different positions. As also shown, a second fixture 12' having a proximal end secured to the opposite end of shaft 14 and a distal or free end having a handle 16' to which the user applies a force for muscle exercise and/or rehabilitation, can be positioned on the opposite side of apparatus 10. In this regard, for example, the right leg or left leg of the user can be exercised and/or rehabilitated with fixture 12 or 12', respectively.

Figure 2:
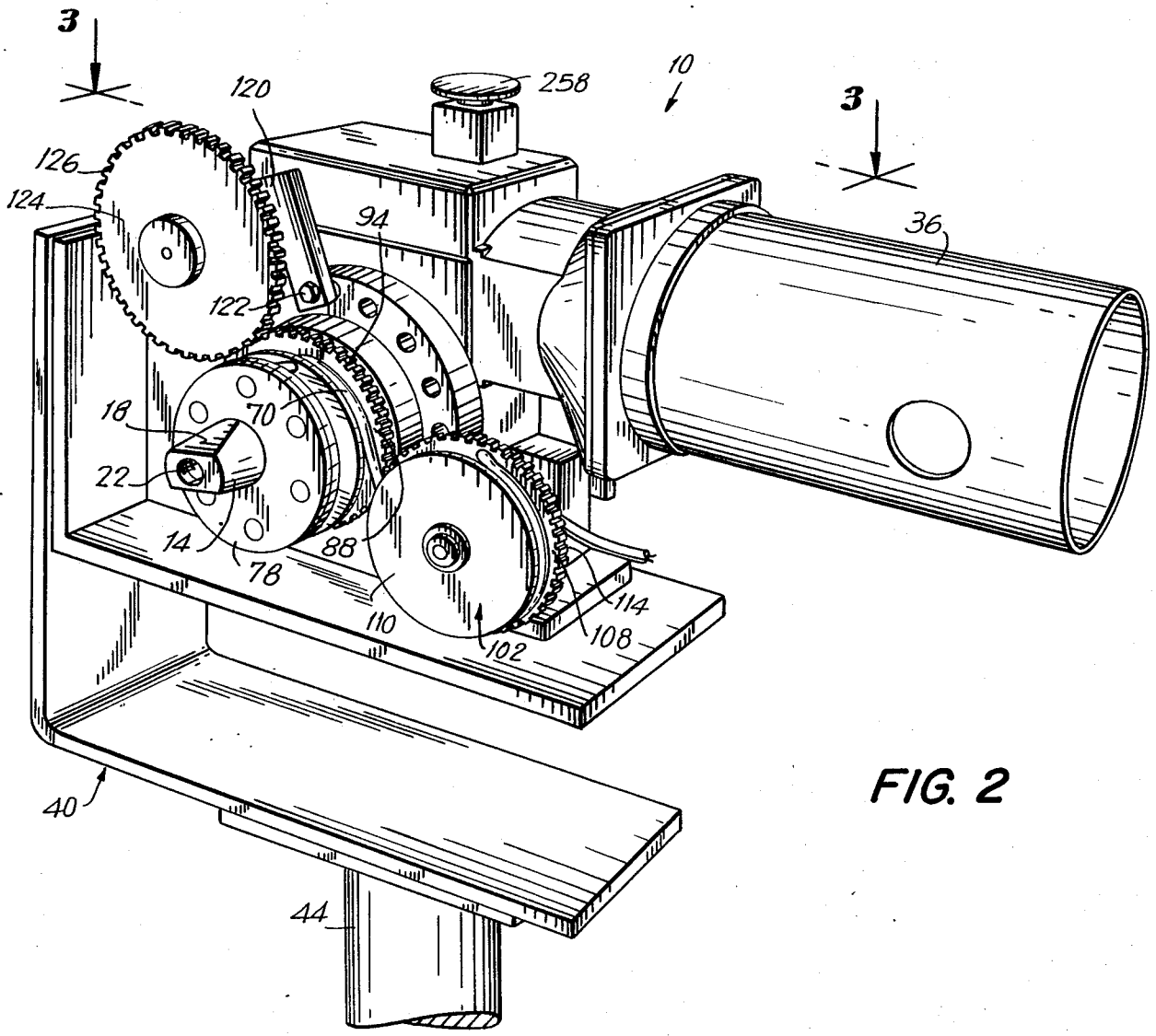
FIG. 2 is a perspective view of the muscle exercise and rehabilitation apparatus of FIG. 1, with the protective cover removed therefrom.
Figure 3:
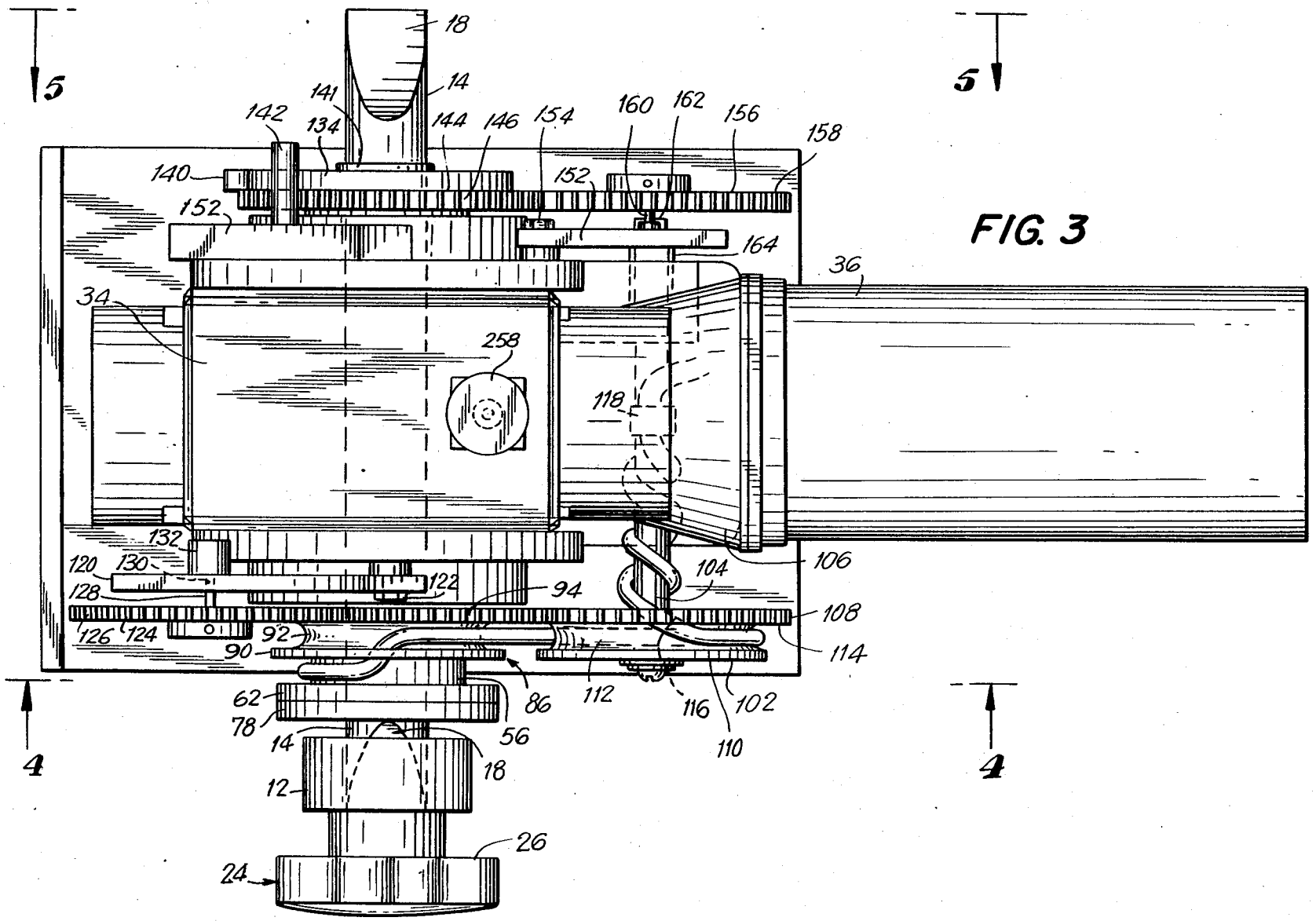
FIG. 3 is a top plan view of the muscle exercise and rehabilitation apparatus of FIG. 2, viewed along line 3—3 thereof.
Figure 4:
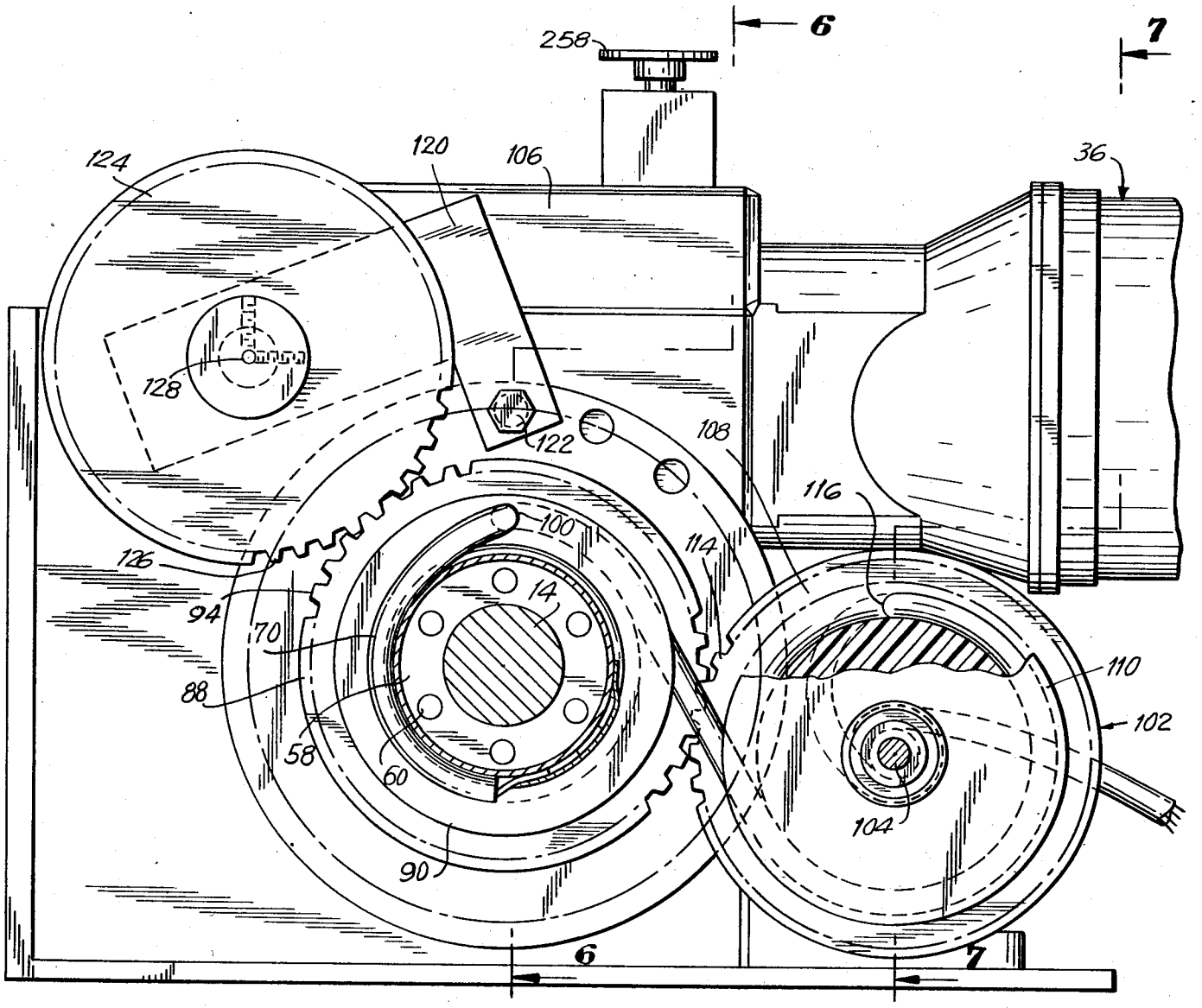
FIG. 4 is a cross-sectional view of the muscle exercise and rehabilitation apparatus of FIG. 3, taken along line 4—4 thereof.
Figure 5:
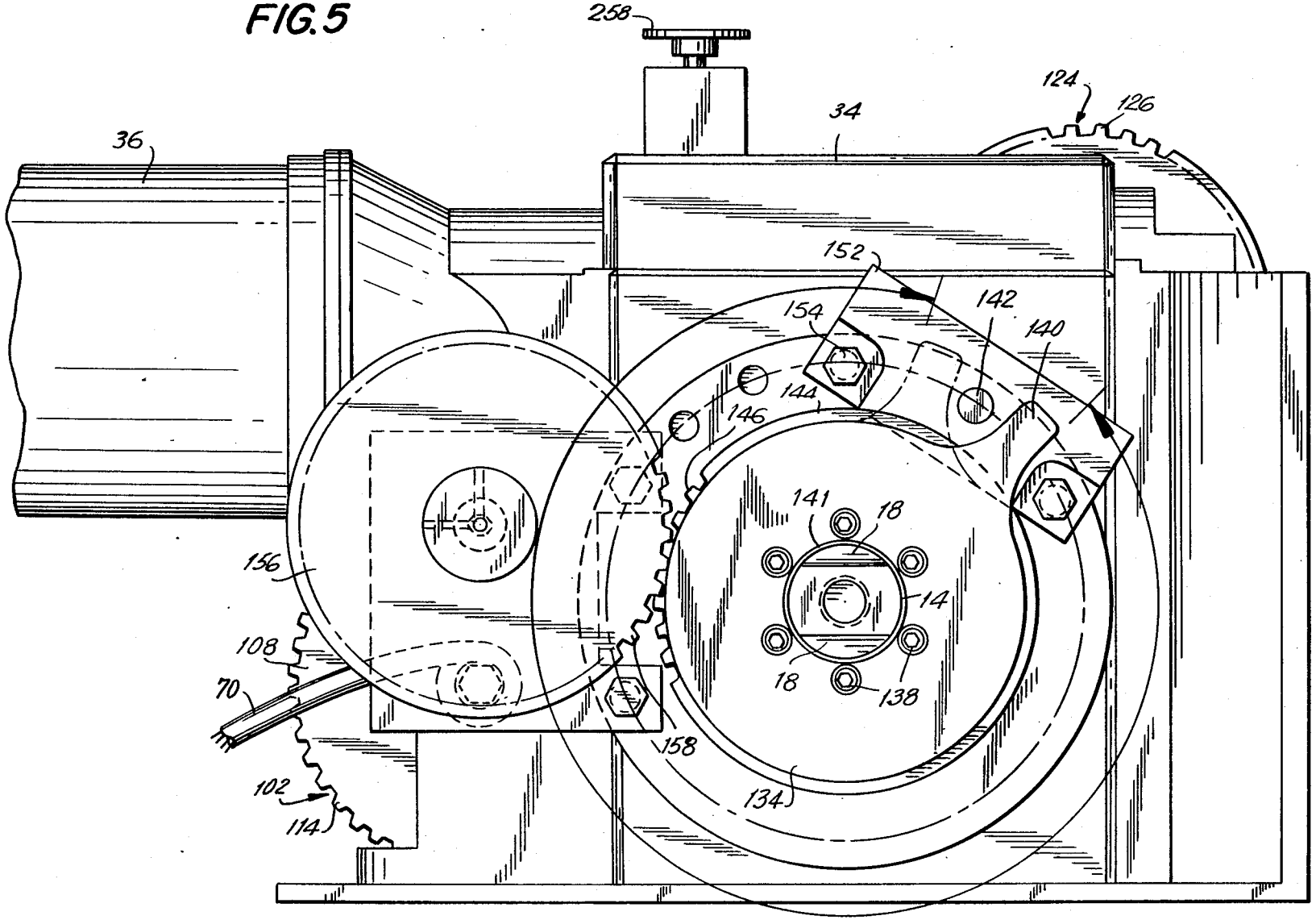
FIG. 5 is a side elevational view of the muscle exercise and rehabilitation apparatus of FIG. 3, viewed along line 5—5 thereof.
Figure 6:
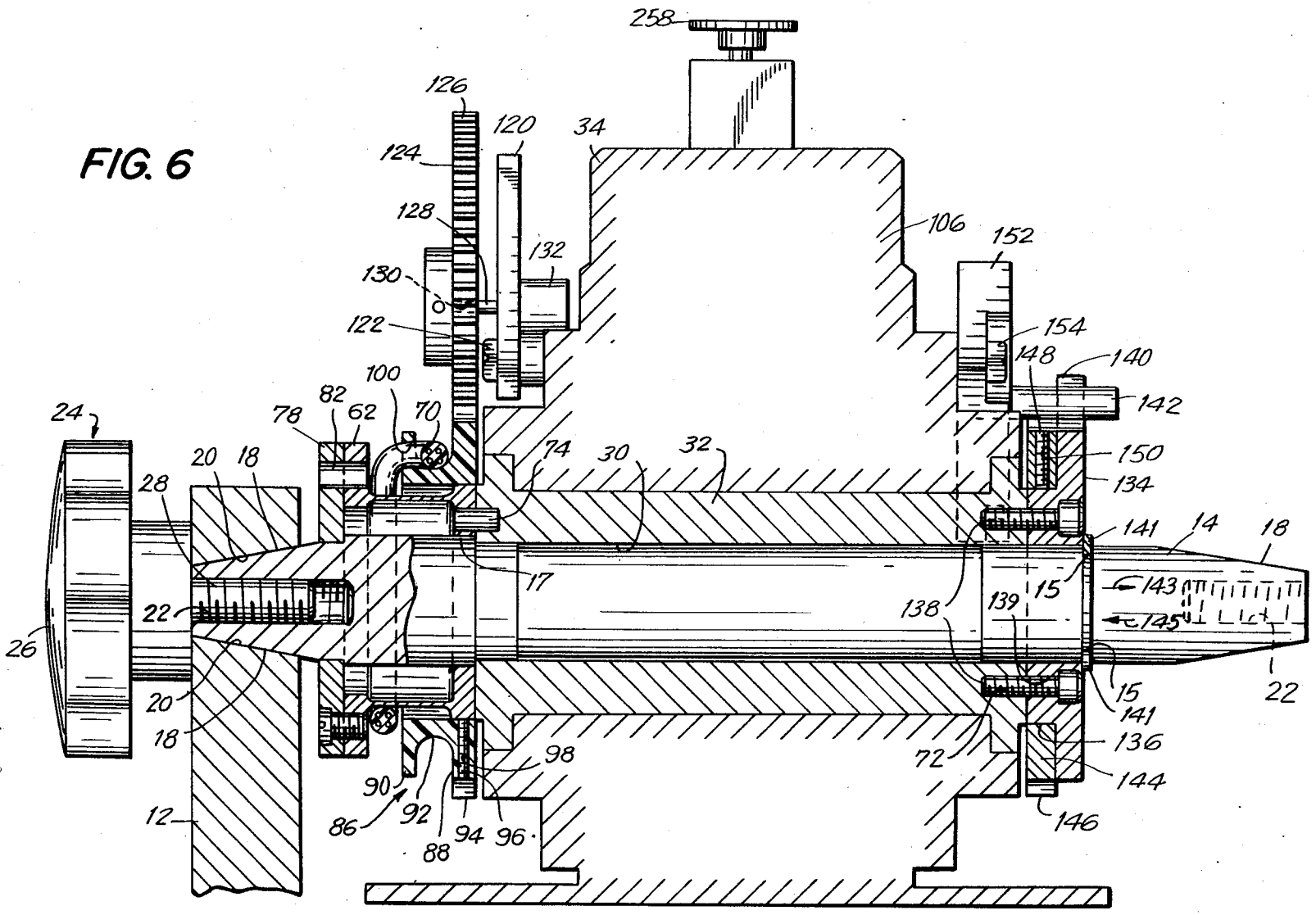
FIG. 6 is a cross-sectional view of the muscle exercise and rehabilitation apparatus of FIG. 4, taken along line 4—4 thereof.
Figure 7:
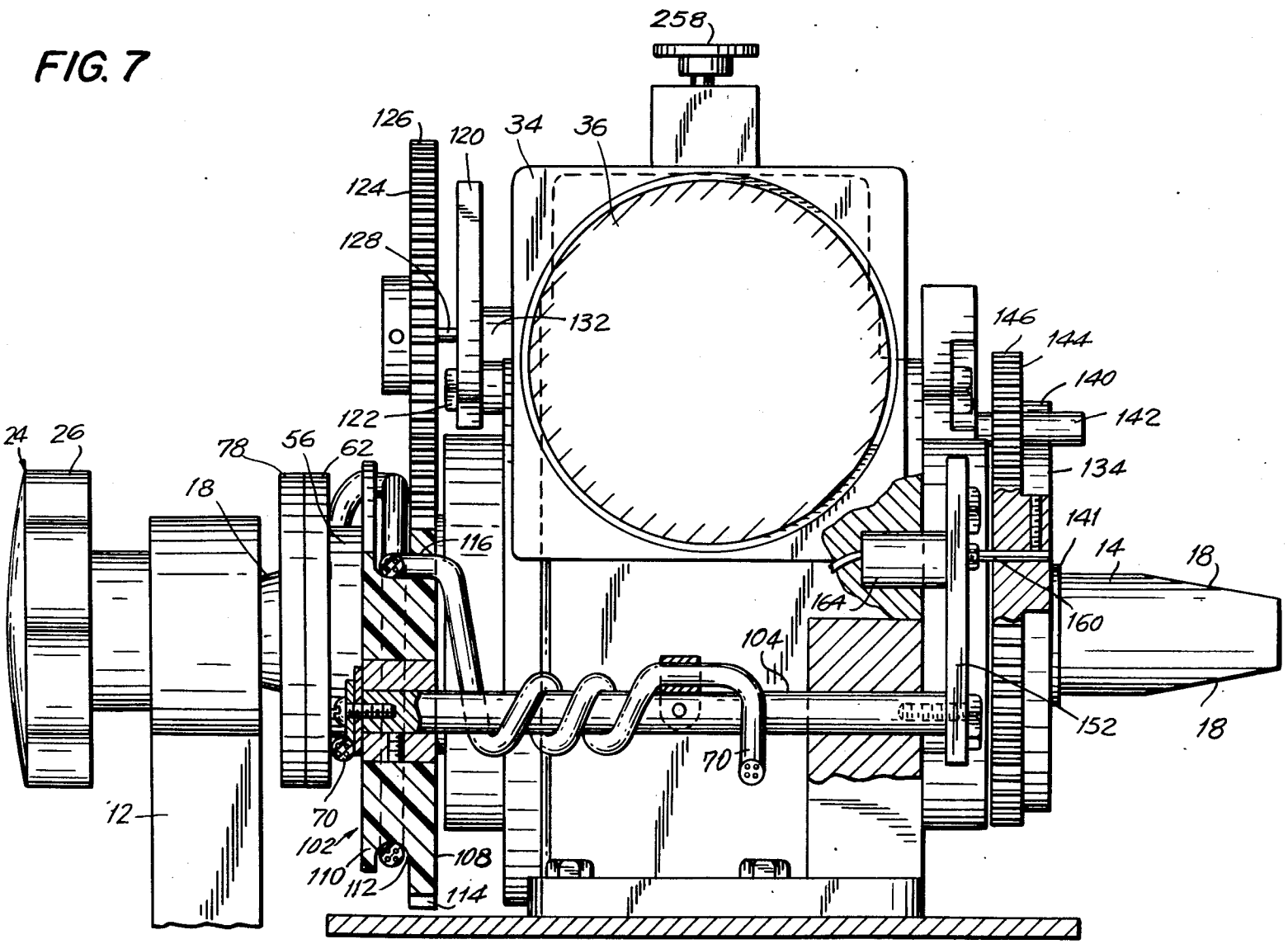
FIG. 7 is a rear elevational view of the apparatus of FIG. 4, viewed from line 7—7 thereof.

As shown in FIGS. 2, 3 and 6, the opposite ends of shaft 14 are outwardly tapered on diametrically opposite sides 18, and fixture 12 contains a correspondingly tapered bore 20 through which shaft 14 extends. The end faces of shaft 14 each contain a central, screw-threaded aperture 22. Also provided is a securing member 24 having an enlarged head 26 and a bolt member 28 extending centrally and axially therefrom. Accordingly, when shaft 14 is positioned through tapered bore 20 of fixture 12, bolt member 28 of securing member 24 is screw-threadedly received within aperture 22. As bolt member 28 is tightened, enlarged head 26 biases the outer surface of fixture 12 to force fixture 12 onto tapered sides 18 of shaft 14 in a wedge-like securing manner. As a result, there is substantially no free play between the connection of fixture 12 and shaft 14, thereby avoiding any backlash. Thus, there is no backlash from this connection which is servoed through the controlled loop velocity servo system, which will be described in greater detail hereinafter.

Shaft 14 is rotatably journalled in a transverse bore 30 extending through an output shaft 32 of a gear box 34 (FIG. 6), for example, having a gear reduction ratio of 30:1, such as a Winsmith 30:1 gear box, or a cycloidal, harmonic or other transmission, and which, in turn, is driven by the output shaft (not shown) of a servo motor 36. The output shaft (not shown) of servo motor 36 is connected to an input shaft (not shown) of gear box 32 by a set screw arrangement. A further set screw is positioned above the first connecting set screw to prevent loosening thereof, thereby further reducing any possible backlash. As will be explained hereinafter in greater detail, servó motor 36, through gear box 34, is controlled to regulate movement of fixture 12. As an example, servo motor 36 may be a high torque, low horsepower motor, such as a one-half horsepower DC servo motor.

As shown in FIG. 1, apparatus 10 is mounted on a stand 38 that permits movement of apparatus with three degrees of freedom. Specifically, apparatus 10 is rotatably mounted between opposite legs of a U-shaped frame 40 of stand 38, and can be rotatably fixed therein at any desired position by tightening bolts 42 which also provide the rotational support for apparatus 10 within U-shaped frame 40. The connecting leg of U-shaped frame 40 is mounted on top of an inner telescoping member 44 which is telescopically and rotatably received in an outer telescoping support 46, the lower end of which functions as a first support point of a tripod-like supporting arrangement. Accordingly, inner telescoping member 44 can be moved vertically in outer telescoping support 46 to vertically adjust the height of apparatus 10, and can also be rotated thereabout. Inner telescoping member 44 can be locked with respect to outer telescoping support 46 by means of a locking bolt 52 extending through outer telescoping member 46 and adapted to engage inner telescoping support 44 when tightened. In this manner, apparatus 10 is supported for movement with three degrees of freedom to permit accurate adjustment of fixture 12 to the particular user and exercise being performed. The other two points of support for the tripod support arrangement are constituted by two L-shaped supports 48, each of which supports a chair 50 on each side of apparatus 10.

Figure 8:
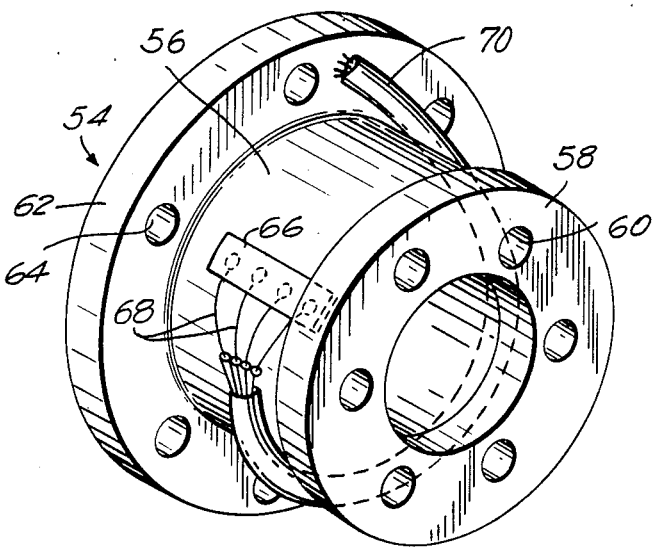
FIG. 8 is a perspective view of the torque sensing tube of the muscle exercise and rehabilitation apparatus of FIG. 2.

Referring now to FIGS. 2–8, and particularly to FIG. 8, a torque sensing tube 54 for detecting the load on fixture 12 or any other fixture will now be described. It will be appreciated from the discussion which follows that torque sensing tube 54 is mounted on shaft 14, thereby overcoming the aforementioned deficiencies in copending U.S. patent application Ser. No. 676,493 of mounting strain gauges on fixture 12.

As shown, torque sensing tube 54 includes a short central tube 56 positioned on one end of shaft 14 between fixture 12 and housing 32. A first annular flange 58 having a plurality of circumferentially spaced bores 60 is fixedly secured to one end of central tube 56, and a second annular flange 62 of a larger diameter and having a plurality of circumferentially spaced bores 64 is fixedly secured to the opposite end of central tube 56. A plurality of 45 degree strain gauges 66 are secured on the outer surface of central tube 56 for detecting twisting of central tube 56. In this manner, strain gauges 66 are sensitive only to the torque applied to fixture 12 which is transmitted through shaft 14, and is not sensitive to other movements, such as axial compression of shaft 14. Strain gauges 66 are connected to respective wires 68 of a wire bundle 70, so as to transmit a signal thereto corresponding to the load applied to fixture 12.

One end of output shaft 32 of gear box 34 is provided with a plurality of circumferentially spaced, screw-threaded apertures 72, and a plurality of securing pins 74 are circumferentially spaced on the opposite end face of output shaft 32, corresponding in number and position to bores 60 of first annular flange 58. With this arrangement, when torque sensing tube 54 is positioned on shaft 14, pins 74 are engaged within bores 60 of flange 58.

At the adjacent flange 62 at the opposite end of torque sensing tube 54, an annular flange 78 is fixedly secured on shaft 14 by welding or the like. Annular flange 78 has an outside diameter substantially identical to that of second annular flange 62 of torque sensing tube 54. Annular flange 78 includes a plurality of inwardly directed securing pins 82 corresponding in number and position to bores 64 of second annular flange 62. Thus, when torque sensing tube 54 is positioned on shaft 14, pins 82 are engaged within bores 64 of flange 62. In this manner, fixture 12 is coupled to output shaft 32 of gear box 34, that is, through torque sensing tube 54.

It will be appreciated that flange 78 is not secured to second annular flange 62 by bolts or the like. In like manner, first annular flange 58 is not secured to output shaft 32 of gear box 34 by bolts or the like. The reason for this is that such tight securement of these members tends to deform central tube 56 of torque sensing tube 54, which results in errors in the output by strain gauges 66. The manner in which shaft 14 is axially fixed with respect to output shaft 32 will be described hereinafter, with respect to the opposite side of shaft 14.

In this regard, when fixture 12 is driven in a given direction by servo motor 36 through bear box 34, if there is a resisting force applied by the user, a twisting of central tube 56 of torque sensing tube 54 occurs, which twisting is measured by strain gauges 66, and the latter produce an output signal corresponding thereto. Thus, if different fixtures 12 or fixtures are used for different purposes, each time that a different fixture is used, the strain gauge need not be changed. Also, the wires attached to strain gauges 66 need not be reattached during each such change, since strain gauges 66 are not mounted on fixture 12. Still further, different vibrations set up for different length fixtures do not affect the sensitivity of strain gauges 66.

In accordance with another aspect of the present invention, wire bundle 70 attached to strain gauges 66 is disposed so as not to interfere with the operation of the apparatus, regardless of the orientation thereof during use. Specifically, a pulley 86 is fit over first annular flange 58 of torque sensing tube 54 in a press fit manner, such that one circumferential flange 88 of pulley 86 is positioned directly over flange 58, and with the other circumferential flange 90 and grooved rim 92 defined between circumferential flanges 88 and 90 being positioned outwardly therefrom toward second annular flange 62 of torque sensing tube 54. It will be appreciated, from FIG. 6, that circumferential flange 90 is spaced inwardly from second annular flange 62 so as to provide a gap therebetween.

As will be described in greater detail hereinafter, circumferential flange 88 of pulley 86 forms a gear having a plurality of teeth 94 spaced therearound. In addition, at least one set screw 96 (FIG. 6) is provided, each extending through a screw-threaded aperture 98 between adjacent teeth 94 on circumferential flange 88 into engagement with first annular flange 58 of torque sensing tube 54 to positively secure pulley 86 thereon.

Circumferential flange 90 is provided with an aperture 100 through which wire bundle 70 extends. Specifically, as shown in FIGS. 2–4, 6 and 7, wire bundle 70 extends from strain gauges 66 and is partially wrapped about central tube 56 in the gap between circumferential flange 90 and second annular flange 62. From there, wire bundle 70 extends through aperture 100 in circumferential flange 90 and wraps partially about grooved rim 92 of pulley 86.

Another pulley 102 is mounted on a shaft 104 which is rotatably journalled through the housing 106 of apparatus 10. Specifically, pulley 102 is of a substantially identical construction as pulley 86, and thereby includes a first circumferential flange 108, a second circumferential flange 110, a grooved rim 112 defined therebetween, and a plurality of gear teeth 114 spaced about first circumferential flange 108. Pulley 102 is positioned adjacent to pulley 86 such that gear teeth 114 thereof are in meshing engagement with gear teeth 94 of pulley 86. In this manner, rotation of pulley 86 causes rotation of pulley 102.

Thus, wire bundle 70 extends from grooved rim 92 of pulley 86 onto grooved rim 112 of pulley 102, and is partially wrapped thereabout. From there, wire bundle 70 extends through an aperture 116 in circumferential flange 108 of pulley 102 and is then wrapped about shaft 104 for a plurality of turns. The free end of wire bundle 70 is then secured to shaft 104 by any suitable securing means 118.

With this arrangement, as fixture 12 rotates, wire bundle 70 is wrapped or unwrapped from shaft 104. As a result, there are no loose or dangling wires. Accordingly, apparatus 10 can be oriented in any manner on stand 38, in three dimensions, and wire bundle 70 will not interfere with the operation thereof.

Referring still to FIGS. 2–4, 6 and 7, an L-shaped bracket 120 is secured at one end to housing 106 by a bolt 122. A gear 124 having teeth 126 is mounted on a shaft 128, which is rotatably journalled within an aperture 130 in the other end of L-shaped bracket 120, such that gear teeth 126 are in meshing engagement with gear teeth 94 of circumferential flange 88 of pulley 86. Of course, it will be appreciated that shaft 128 could be journalled within a bearing (not shown) within L-shaped bracket 120. Gear 124 constitutes a position sensing gear, and in this regard, is connected to a position sensor 132 which, in turn, supplies a signal corresponding to the position of fixture 12, to the circuitry of apparatus 10, which will be described in greater detail hereinafter.

Referring now to FIGS. 3, 5, 6 and 7, the mechanical elements at the opposite side of apparatus 10 will now be described. As shown, an annular plate 134 having an inwardly formed circumferential shoulder 136 is secured to the opposite side of output shaft 32 of gear box 34 by bolts 138 extending through circumferentially arranged apertures 139 in annular plate 134 into screw-threaded engagement with the aforementioned screw-threaded apertures 72 of output shaft 32. In order to axially fix shaft 14 to output shaft 32 of gear box 34, a circumferential groove 15 is formed in shaft 14, immediately to the outside of annular plate 134. A C-ring 141, having a preferable angular range of approximately 220 degrees, is positioned about shaft 14 and within groove 15 thereof. Therefore, an attempt to move shaft 14 in the axial direction to the left of FIG. 6, causes C-ring 141 to abut against annular plate 134, thereby limiting movement of shaft 14. At the opposite end of shaft 14, shaft 14 is formed with a section 17 having a larger diameter. Therefore, an attempt to move shaft 14 in the axial direction to the right of FIG. 6, causes section 17 to abut against the end face of output shaft 32 of gear box 34, thereby again limiting movement of shaft 14. Since shaft 14 is so limited against axial movement, flange 78 thereon maintains torque sensing tube 54 from also moving axially, while not placing any undue axial tightening forces thereon. Accordingly, strain gauges 66 on torque sensing tube 54 accurately measure the force applied to fixture 12.

Annular plate 134 is also formed with an outwardly radial directed projection 140, which cooperates with a stop pin 142 secured to housing 106. With this arrangement, pin 142 prevents rotation of output shaft 32, and thereby fixture 12, greater than one revolution. This prevents the mechanical forcing of output shaft 32 past a starting position when the system is shut down, since such mechanical forcing would confuse the circuitry of apparatus 10, and could result in injury to the user when apparatus 10 is started. Further, such pin 142 functions as a calibration point for all position sensing operations.

A gear 144 having gear teeth 146 is secured on shoulder 136 by means of at least one set screw 148, each set screw 148 extending through a respective aperture 150 between adjacent gear teeth 146 and into engagement with shoulder 136.

A bracket 152 is secured to housing 106 by bolts 154. A gear 156 having teeth 158 is mounted on a shaft 160, which is rotatably journalled within an aperture 162 in bracket 152, such that gear teeth 158 are in meshing engagement with gear teeth 146 of gear 144. Of course, it will be appreciated that shaft 160 could be journalled within a bearing (not shown) within bracket 152. Gear 156 constitutes a redundant position sensing gear, and in this regard, is connected to a redundant position sensor 164 which, in turn, supplies a signal corresponding to the position of fixture 12, to the circuitry of apparatus 10, which will be described in greater detail hereinafter.

Referring back to FIG. 1, apparatus 10 further includes circuitry for controlling operations of fixture 12, such circuitry being contained in a housing 166 having a control panel 168 for controlling such operations. Such circuitry is connected by suitable wiring (not shown) to the aforementioned apparatus, such as, to servo motor 36, position sensors 132 and 164, strain gauges 66 and other elements which will be described hereinafter. In addition, various other components can be utilized with such circuitry for analyzing data and the like. For example, a computer 170, such as an IBM PC, having a keyboard 172 and monitor 174 can be used for analyzing data, along with a printer 176 for producing a hard copy of such data.

Figure 9:
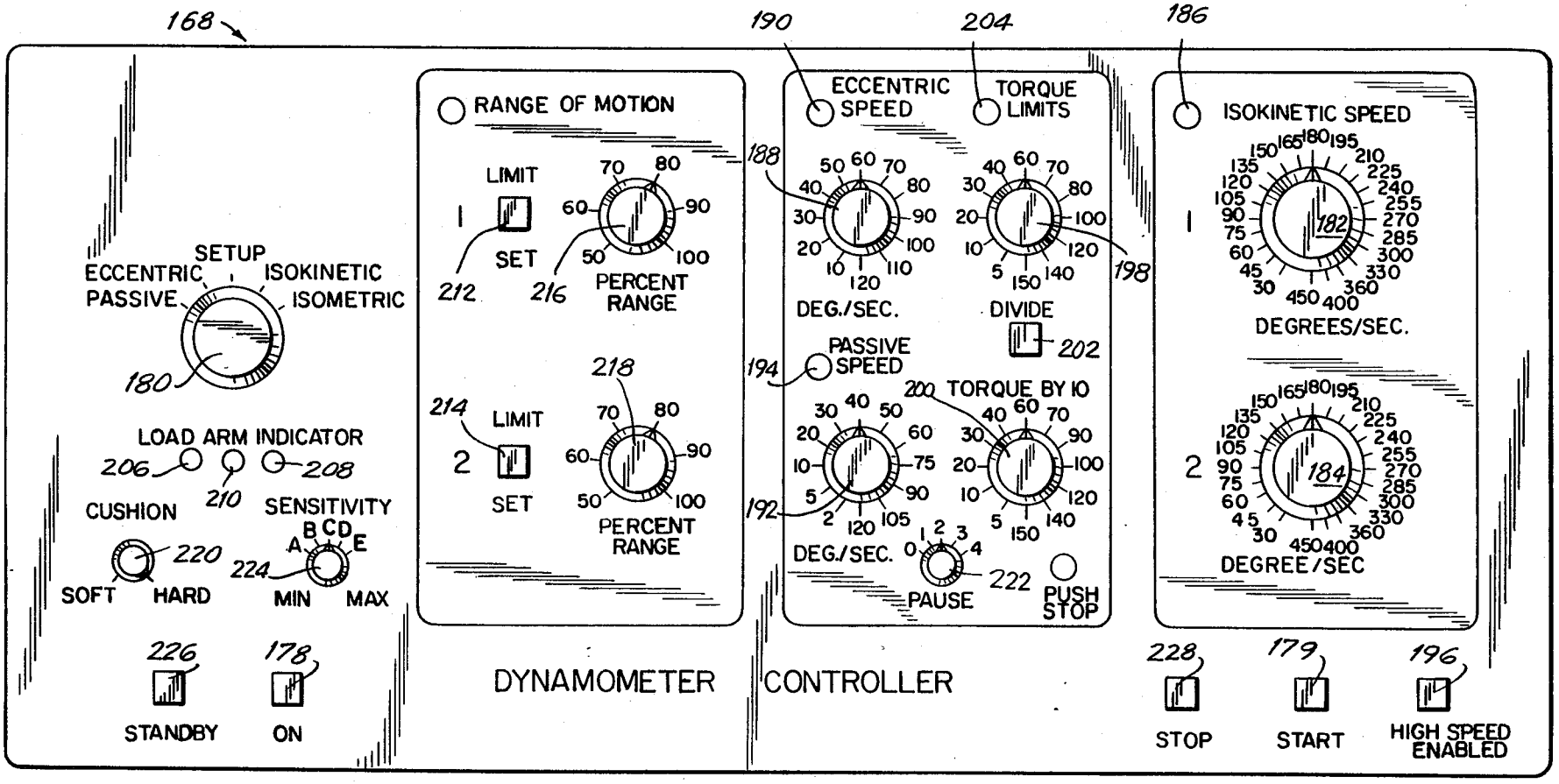
FIG. 9 is a front elevational view of the control panel for the circuitry used with the muscle exercise and rehabilitation apparatus of FIG. 1.

Referring now to FIG. 9, control panel 168 is shown in greater detail. As shown, control panel 168 includes an ON button 178 for rendering apparatus 10 operative, a START button 179 for starting an operation, and a mode switch 180 for setting the mode of operation of apparatus 10. Specifically, apparatus 10 operates in five distinct modes, namely, a concentric isokinetic, eccentric isokinetic, passive (oscillation), isometric or set-up mode.

In the concentric isokinetic mode, regardless of the force applied by the user, servo motor 36 drives fixture 12 at a velocity dependent upon the force applied by the user and in the same direction as the force applied by the user. Once a preset velocity is reached, servo motor 36 drives fixture 12 at that preset velocity. The concentric isokinetic mode is operative for both clockwise and counte-clockwise movements of fixture 12.

The eccentric isokinetic mode operates in the same manner as the concentric isokinetic mode, with the difference being that servo motor 36 drives fixture 12 at a velocity dependent upon the force applied by the user and in the opposite direction as the force applied by the user. Once the user applies a sufficient force to cause servo motor 36 to drive fixture 12, servo motor 36 to drive fixture 12 in a direction against the force of the user up to a maximum preset velocity, dependent upon the force applied by the user.

In the passive or oscillation mode, fixture 12 is caused to oscillate at a regulated velocity, regardless of the force applied thereto. This mode is particularly desirable as a therapeutic mode in which a patient's limb is oscillated by fixture 12, without any force being applied by the patient. If, however, the patient does apply a force in either direction, servo motor 36 maintains the angular velocity of fixture 12 constant. In this regard, servo motor 36 controls movement of fixture 12 in response to the load applied to fixture 12 and to the velocity of fixture 12.

In the isometric mode, servo motor 36 maintains fixture 12 stationary at a desired position, and the user applies a force against fixture 12. The set-up mode, as will be described in greater detail hereinafter, is used to set the limits of the angular range of motion of fixture 12, without any injury to the user.

In order to set the angular speeds of movement of fixture 12 in the concentric isokinetic mode, a clockwise speed knob 182 and a counter-clockwise speed knob 184 are provided for setting the maximum clockwise and counter-clockwise angular speeds of fixture 12. As shown, each knob 182 and 184 can regulate the angular speed of fixture 12 between 30 and 450 degrees/second, although the present invention is not limited to this range. A light 186 is provided adjacent knobs 182 and 184, and is illuminated when mode switch 180 is set for the concentric isokinetic mode.

For the eccentric isokinetic mode, a single speed knob 188 is used to regulate the angular speed of fixture 12 between 10 and 120 degrees/second. Because fixture 12 is caused to move with a constant speed in a direction opposite to the application of force by the user, the range of speeds is, of course, much smaller than those in the concentric isokinetic mode, and there is only need for one knob 188 to regulate the angular speeds for clockwise and counter-clockwise directions. Also, a light 190 is provided adjacent knob 188, and is illuminated when mode switch 180 is set for the eccentric isokinetic mode. In the eccentric mode, it is to be noted that a threshold torque must be applied in order to initially move fixture 12. This threshold torque is approximately 10% of the maximum torque set by torque limit knobs 198 and 200 to be described in greater detail hereinafter.

For the passive mode, a single speed knob 192 is used to regulate the angular speed of fixture 12 between 2 and 120 degrees/second. Because the user is ideally not applying any force on fixture 12, the range of speeds is, of course, much smaller than those in the concentric isokinetic mode, and there is only need for one knob 192 to regulate the angular speeds for clockwise and counter-clockwise directions. Also, a light 194 is provided adjacent knob 192, and is illuminated when mode switch 180 is set for the passive mode.

In the eccentric and passive modes, it can be dangerous if the speed settings are initially set above 60 degrees/second. Accordingly, if it is attempted to move fixture 12 greater than 60 degrees/second at the start of the eccentric and passive modes, the internal circuitry will prevent movement of fixture 12. At the same time, a HIGH SPEED ENABLE button 196 flashes as a warning to indicate this. Although apparatus 10 permits initial movement of fixture 12 in the eccentric and passive modes at angular speeds greater than 60 degrees/-second, in order to achieve this, both HIGH SPEED ENABLE button 196 and START button 179 must be pressed at the same time.

In the passive mode, it is also necessary to provide torque limits, that is, to provide a maximum torque that can be applied by the user. This is provided in order to prevent injury to the user. It is important to note that the torque limits are only set in the passive mode, since in the isokinetic modes, the speed of fixture 12 is controlled by the force applied by the user. Thus, two torque limit knobs 198 and 200 are provided, torque limit knob 198 controlling the torque limits in the range of 5 to 150 foot-pounds in a first direction, and torque limit knob 200 controlling the torque limits in the range of 5 to 150 foot-pounds in a second, opposite direction. It will be appreciated that it is difficult to accurately set a small torque in view of the high levels of the range associated with torque limit knobs 198 and 200. In order to select such a small torque, a torque select button 202 is provided, which reduces the range associated with each torque limit knob 198 and 200 by one-tenth, for example, 0.5 to 15 foot-pounds. When undepressed, the higher range of torque limit knobs 198 and 200 is operative, and when depressed, button 202 is illuminated and the lower range is operative. Also, a light 204 is provided adjacent knob 198, and is illuminated when mode switch 180 is set for the passive mode.

In the isokinetic and passive modes, when the load applied to fixture 12 exceeds a maximum set load corresponding to the preset angular speeds set by speed knobs 182, 184, 188 and 192, either a red light 206 or 208 is illuminated, depending on the direction of movement of fixture 12. For example, in the clockwise direction, red light 206 is illuminated and in the counter-clockwise direction, red light 208 is illuminated. On the other hand, if the maximum set load is not exceeded, a green light 210 is illuminated.

In order to set the limits of the range of angular motion of fixture 12, LIMIT buttons 212 and 214 are provided for setting the limits in the clockwise and counter-clockwise directions. Thus, it is only necessary for the user to extend his limb, and thereby fixture 12, to the desired angular extent, and depress the respective LIMIT button 212 or 214, thereby setting the maximum angular limits. This is performed only in the set-up mode of operation. Thus, there is no adjustment of the limits by a trial and error method using knob settings, and thereby no danger to the user since the limits can not initially be adjusted for an excessive angular limit. Associated with LIMIT switches 212 and 214 are LIMIT knobs 216 and 218, respectively, which can reduce the limits to a range of 50 to 100 percent of the set limits.

Further, in accordance with the present invention, the amount of cushioning, that is, acceleration and deceleration near the angular limits, can be adjusted by a cushion knob 220. Basically, for a soft cushion, deceleration starts at an earlier time than for a hard cushion. As will be described in greater detail hereinafter with respect to the particular circuitry, the cushioning effect according to the present invention is smooth, and is accurate so that fixture 12 stops at the set angular limit and does not overshoot the same. Also, in the passive mode, at the angular limits, fixture 12 must pause in order to change direction. The amount of such pause is controlled by a pause control knob 222.

As discussed above, for different length fixtures 12, different vibrations are set up. For example, for a longer fixture, during fast acceleration of the fixture in a whipping action, a large vibration may be set up. On the other hand, for a shorter fixture, there will be less sensitivity by the strain gauge. In order to compensate for this, the circuitry is provided with means for adjusting the sensitivity, that is, the amount of gain, of strain gauges 66. The sensitivity is controlled by a sensitivity knob 224.

Lastly, a STANDBY button 226 and a STOP button 228 are provided, which are illuminated when there is an emergency stop or a failure in the system, as will be described in greater detail hereinafter. Thus STANDBY button 226 or stop button 228 are illuminated when a safety circuit has been activated. In order to again start operation of apparatus 10, the respective button 226 or 228 must be depressed. At such time, all limits that had previously been set are cancelled, and the user must reset the entire control panel 168.

Figure 10:
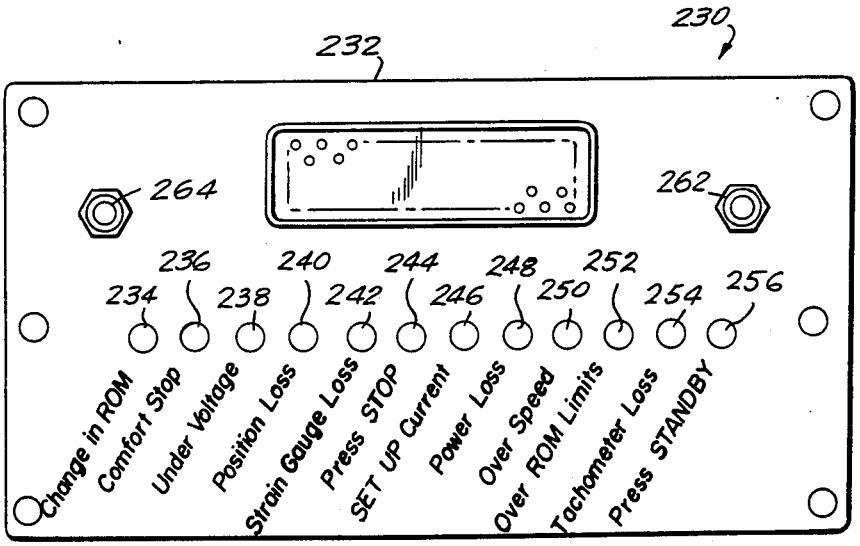
FIG. 10 is a rear elevational view of the indicator panel of the muscle exercise and rehabilitation apparatus of FIG. 2.

In regard to the safety functions performed by apparatus 10, reference will now be made to indicator panel 230 at the rear of housing 106, as shown in FIG. 10. Indicator panel 230 includes a plug connection 232 for connecting the electro-mechanical elements of apparatus 10 to the circuitry thereof, and a plurality of indicator lights 234–256, each of which are illuminated in correspondence with one or more modes of failure of apparatus 10.

At the outset, if any indicator light 234–242 is illuminated, Press STOP light 244 is also illuminated. At the same time, STOP button 228 on control panel 168 flashes. In such case, the circuitry controls servo motor 36 to go to zero speed, with residual power in a capacitive element of a servo amplifier, to be described in greater detail hereinafter. This is necessary since power is cut off to the servo amplifier. In like manner, if any indicator light 246–254 is illuminated, Press STANDBY light 256 is also illuminated. At the same time, STANDBY button 226 on control panel 168 flashes. In such case, all power to apparatus 10 is interrupted, and the servo amplifier is disabled. This is because there is no way to control servo motor 36. For example, when there is a Tachometer Loss, there is no way the circuitry can control servo motor 36 to go to zero speed, since there is no way to detect speed at such time. Accordingly, all power is shut down entirely, and the system disabled. At such time, indicator lights 254 and 256 are illuminated. It will be appreciated from the discussion which follows that, in the STANDBY mode, a dynamic brake is set to provide a smooth braking operation as fast as can be performed with a loss of power.

As to indicator light 234, this corresponds to a change in the range of motion (ROM), that is, when the angular limits which have been set are changed by a certain percentage from the set amounts. Otherwise, the user could be injured.

Indicator light 236 indicates when a comfort stop button 258 (FIGS. 1–7) has been depressed. This is a safety button that the user can depress in an emergency. The user also has a comfort stop button (not shown) which he can hold during the operation of apparatus 10, instead of reaching over to comfort stop button 258.

Indicator light 238 indicates when the voltage from the power supply is less than a predetermined voltage. This determination is made by comparing the power supply voltage to a voltage from a Zener diode. For example, if the power supply voltage is less than 13 volts, indicator light 238 indicates that there is an under voltage.

Indicator light 240 indicates when there is a position loss, that is, when the circuitry can no longer determine the angular position of fixture 12. Indicator light 242 indicates a strain gauge loss, that is, if strain gauges 66 become disconnected or break.

In the set-up mode, the current that can be supplied to servo motor 36 is limited to one-fifth that of the maximum current that can be supplied. Since there are no limits set when the set-up mode is first entered, if there was no such limitation on the current, the user could be injured if apparatus 10 was not operating properly. Accordingly, if the current during the set-up mode is greater than 20% of the maximum current, apparatus 10 shuts down, and indicator light 246 is illuminated.

If there is a power loss or if the speed settings are exceeded, indicator lights 248 and 250, respectively, are illuminated. Indicator light 252 is illuminated if the range of motion (ROM) which has been set is exceeded, which could cause injury to the user.

On indicator panel 230, there is also a jack 262 for insertion of a plug (not shown) associated with a comfort stop actuated by the user. For example, the user can hold a push button in his hand which is connected to jack 262 through suitable wiring and a plug. When the user wants to immediately stop apparatus 10, he merely depresses such a push button. Such push button operates in the same manner as comfort stop button 258 on apparatus 10.

In addition, a balance knob 264 is provided on indicator panel 230. By turning balance knob 264, an offset is placed on strain gauges 66, that is, there is a deviation from the desired zero or null position measured thereby, whereby servo motor 36 moves fixture 12 to a desired angular position. Balance knob 264 is particularly used in the isokinetic mode of operation.

Figure 11:
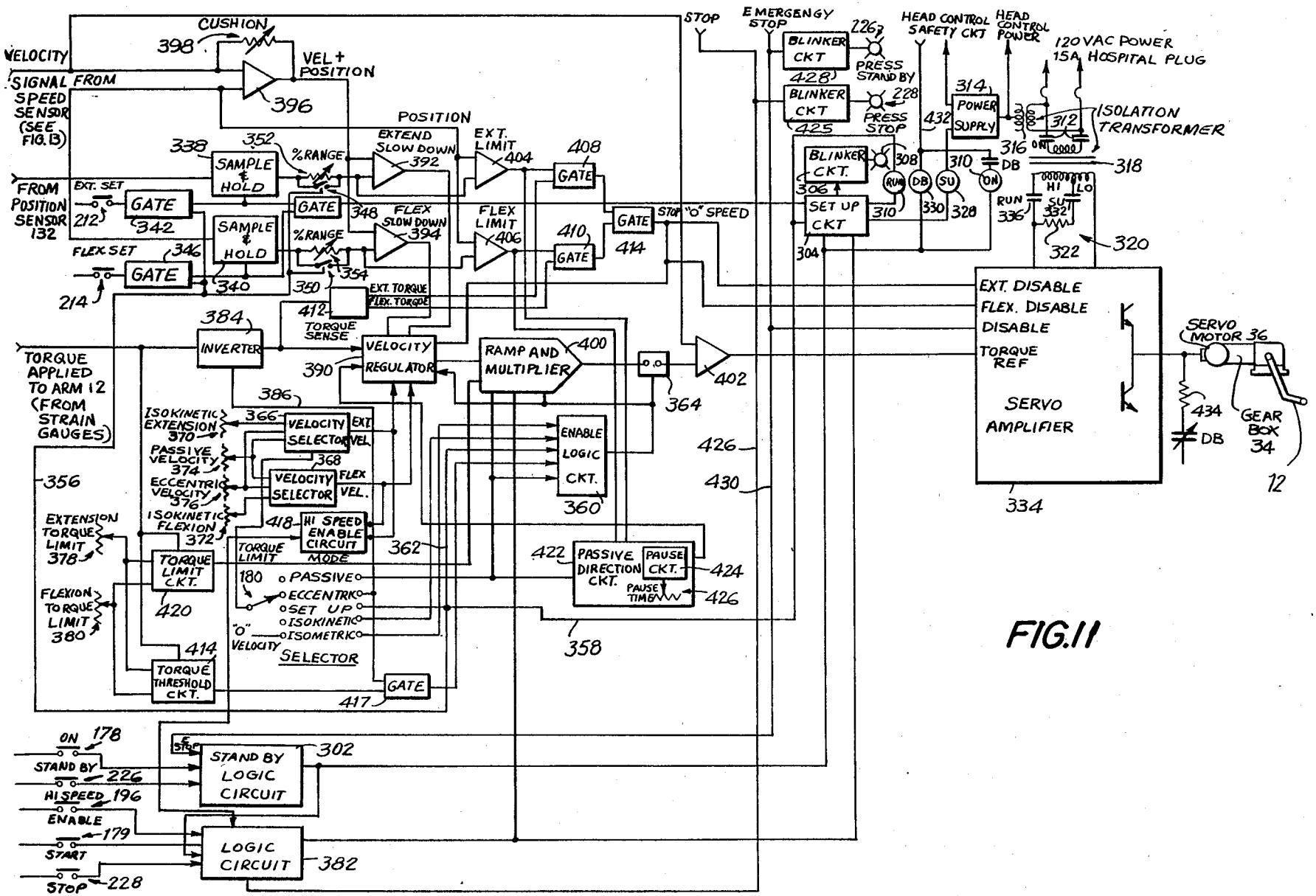
FIG. 11 is a block diagram of the control circuit for the muscle exercise and rehabilitation apparatus of FIG. 1.
Figure 12A:
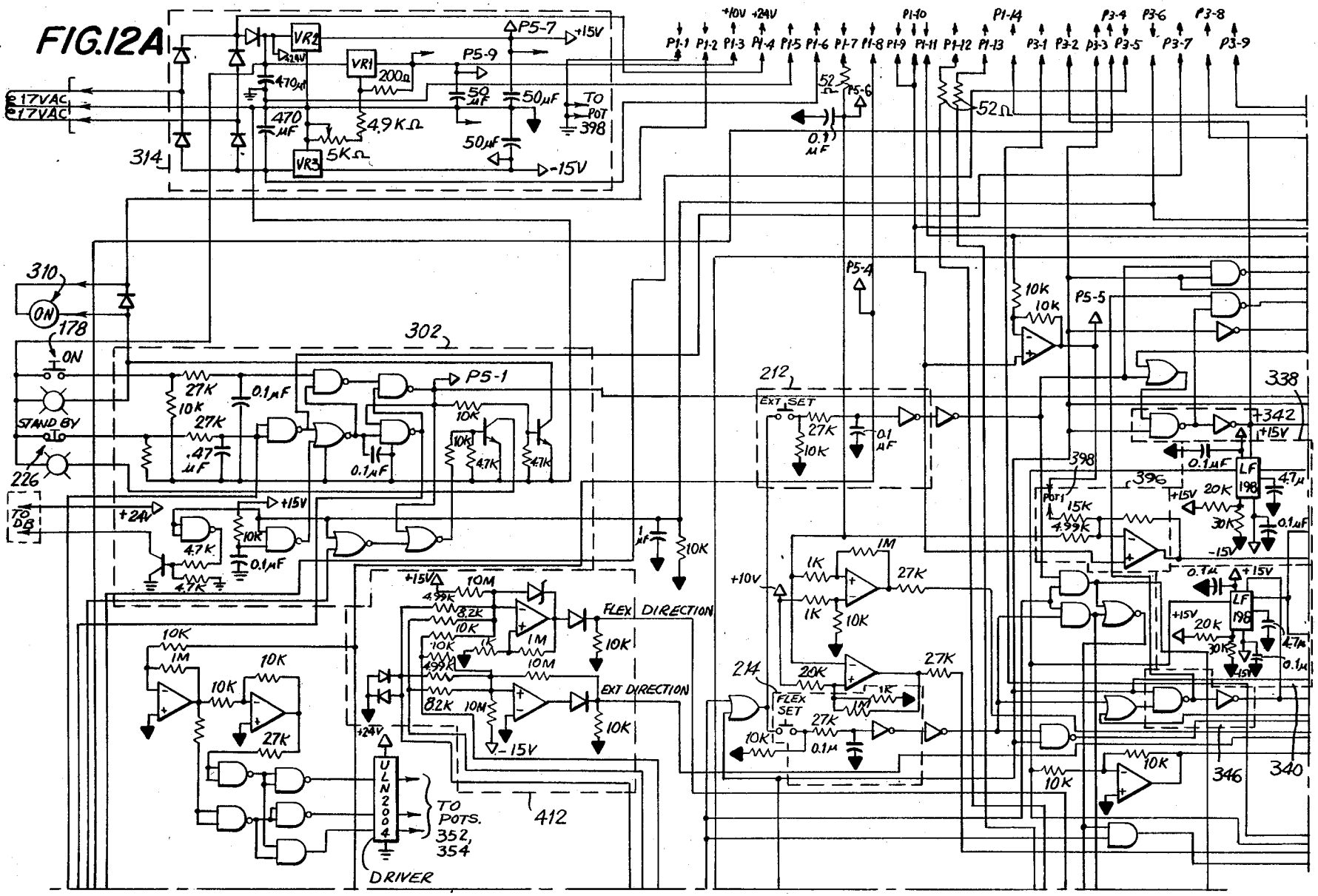
FIGS. 12A–12D constitute a detailed wiring diagram of the control circuit of FIG. 11.
Figure 12B:
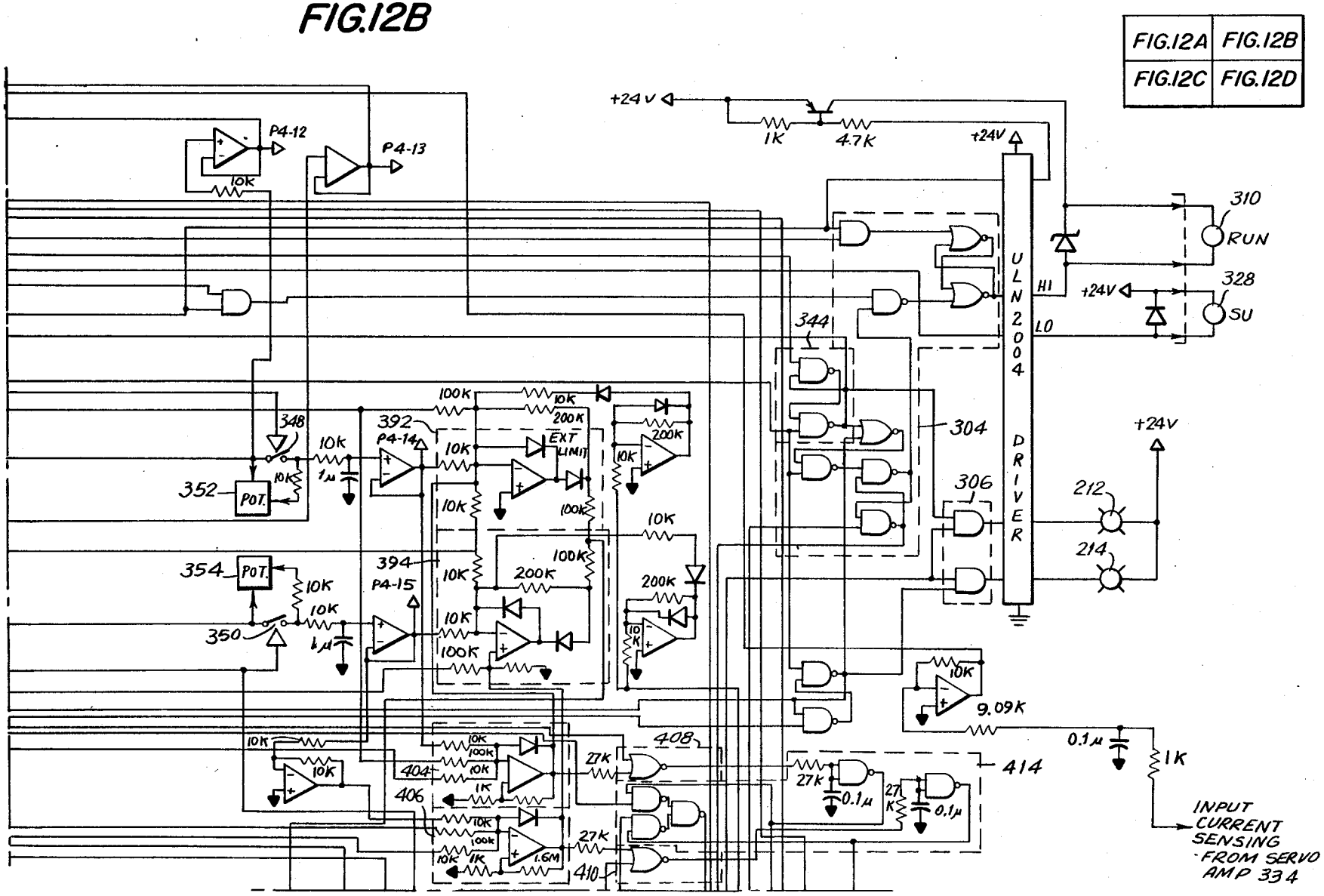
Figure 12C:
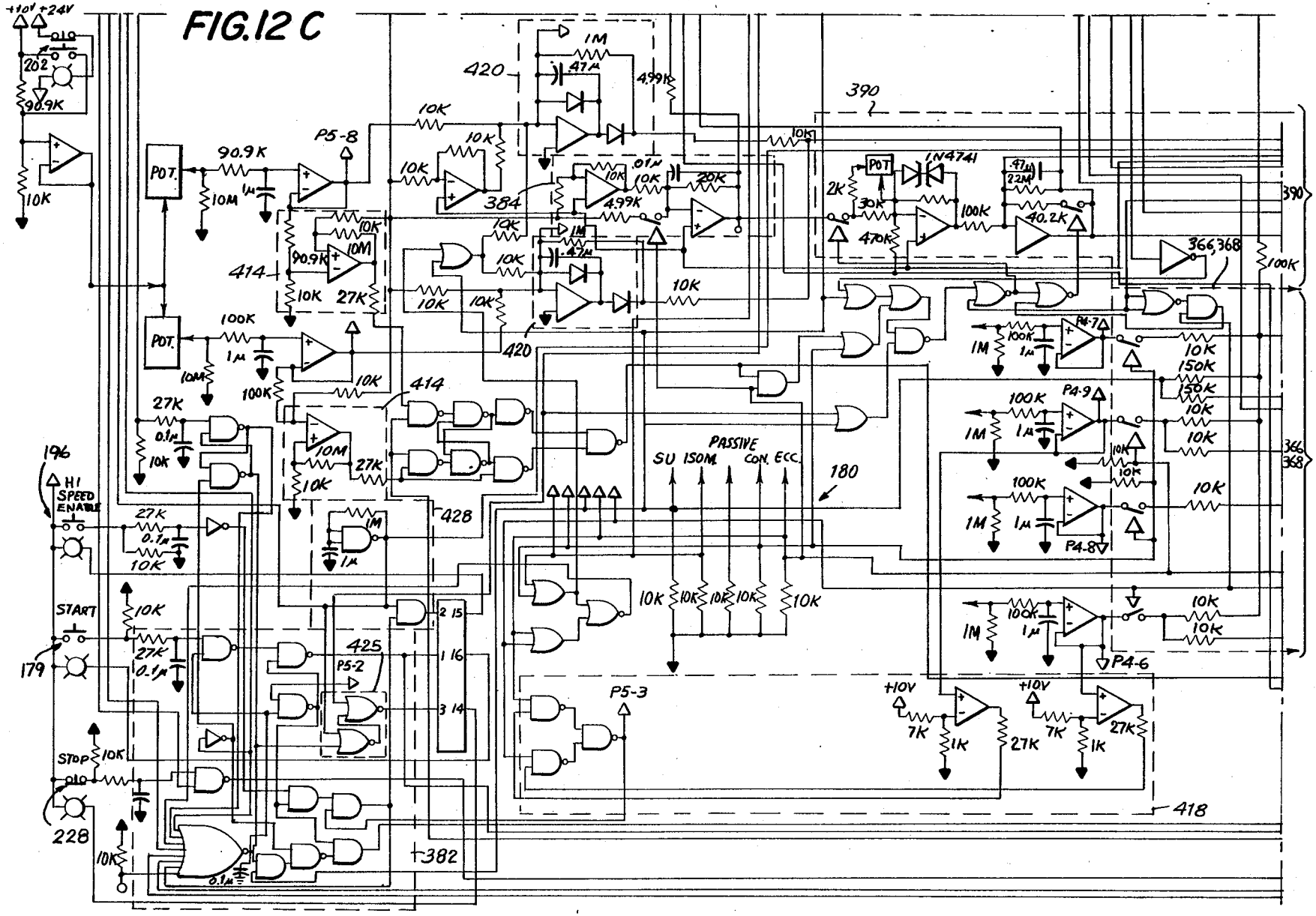
Figure 12D:
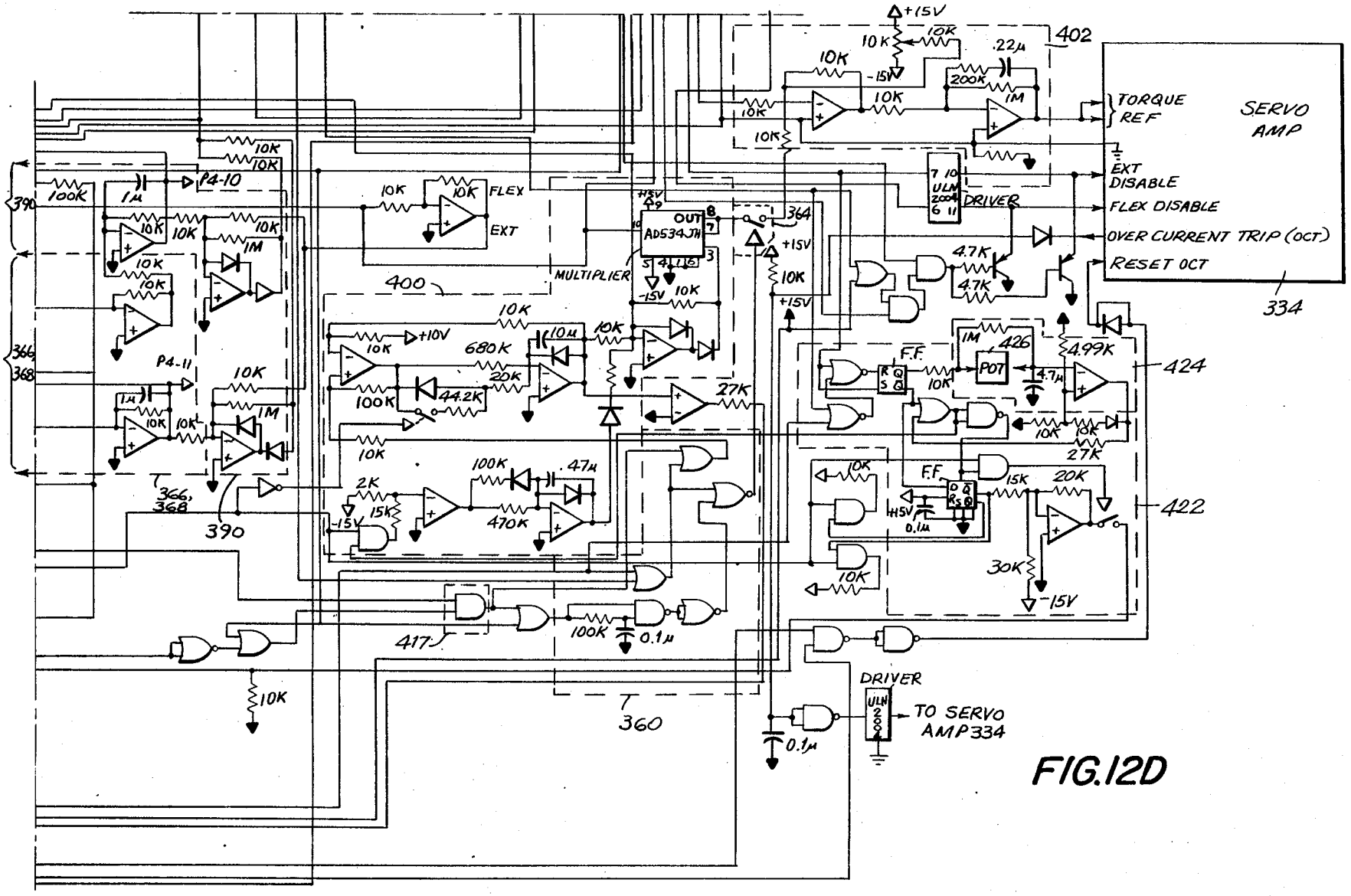

Referring now to FIG. 11, there is shown a general block diagram of the control circuit 300 for controlling the operation of apparatus 10.

When ON button 178 is depressed, logic circuit 302 is activated to transmit a signal to set-up circuit 304. At such time, set-up circuit 304 activates a blinker circuit 306, which causes lights, indicated generally by numeral 308, in clockwise limit button 212 and counterclockwise limit button 214, to blink, thereby indicating to the user that the angular range of motion limits must be set, before operation can begin. Thus, the user must set mode switch 180 to the set-up position in order to set the same before operation can begin. Further, when ON button 178 is depressed, logic circuit 302 activates ON relay 310, which in turn, closes ON contacts 312, which connects a power supply 314 to the system through two isolation transformers 316 and 318 and a low power limit circuit 320 having a limiting resistor 322. Also, a dynamic brake (DB) relay 324 and dynamic brake (DB) contact 326 are connected in the circuit, although these are only activated by a signal from the head control safety circuit to be described in detail hereinafter.

In response to movement of mode switch 180 to the set-up position, switch 180 supplies a signal to set-up circuit 304, which activates the set-up relay 328 and drops the RUN relay 330 to ensure that apparatus 10 does not begin its normal operation until the angular range of motion limits have been set. Thus, the set-up (SU) contact 332 is closed to provide low power to a servo amplifier 334 for servo motor 36, and RUN contact 336 is open. Thus, in the set-up mode, there is a low voltage on the motor control, whereby servo motor 36 is prevented from exceeding a predetermined speed, for example, one-tenth the maximum speed. The reason for this is that no limits have been set yet, and if apparatus 10 malfunctions, the user can get hurt. Therefore, during the set-up mode, only 20% of the full load current is used.

The operation for setting the limits in the angular range of motion will now be described. The output signal from position sensor 132, corresponding to the position of fixture 12, is supplied to a first sample and hold circuit 338 and a second sample and hold circuit 340. The user first moves his limb to a desired angular limit in a first direction, for example, for extension of the limb, and LIMIT button 212 is depressed, resulting in a signal being supplied to a gate 342. This results in the blinking light associated with LIMIT button 212 being extinguished. Gate 342 is enabled by mode switch 180 and LIMIT button 212 and, in turn, supplies a signal to sample and hold circuit 338, causing the latter to sample and hold the signal from position sensor 132 as the first angular limit. The signal from gate 342 is also supplied to one input of a gate 344. In like manner, the user next moves his limb to a desired angular limit in a second, opposite direction, for example, for flexion of the limb, and LIMIT button 214 is depressed, resulting in a signal being supplied to a gate 346. This results in the blinking light associated with LIMIT button 214 being extinguished. Gate 346 is enabled by mode switch 180 and LIMIT button 214 and, in turn, supplies a signal to sample and hold circuit 340, causing the latter to sample and hold the signal from position sensor 132 as the second angular limit. The signal from gate 346 is also supplied to another input of gate 344. In response to the signals from gates 342 and 346, gate 344 supplies a signal to set-up circuit 304 to indicate that the angular range of motion limits have been set.

At the same time, mode switch 180 supplies a signal to close switches 348 and 350, respectively, to eliminate use of potentiometers 352 and 354 associated with percent LIMIT knobs 216 and 218. In other words, the limits that are set are 100% limits. Further, mode switch 180 also supplies a signal directly to set-up circuit 304 through line 358, and to an enable logic circuit 360 along line 362. Enable logic circuit 360 ensures that mode switch 180 is positioned at a mode selection such as passive, eccentric and the like. If so, enable logic circuit 360 closes a switch 364. If, for example, mode switch 180 is positioned between two mode selections, enable logic circuit 360 opens switch 364 to prevent movement of fixture 12.

Further, during the set-up mode, the mode switch selects the maximum velocity obtainable at 1/10 of the rated maximum isokinetic speed. It will be remembered that the speeds that can be achieved during set-up are only one-tenth of the set speeds because RUN relay 310 is dropped out. This enables the user to move fixture 12 to a desired limit position.

At this time, the user may wish to set any other speed or torque limits, depending upon the anticipated use of apparatus 10, that is, depending upon the mode to be used. Thus, the angular speed for the passive mode can be set through potentiometer 374 associated with passive speed knob 192, and which is connected to respective inputs of velocity selectors 366 and 368. In like manner, the angular speed for the eccentric mode can be set through potentiometer 376 associated with eccentric knob 188, and which is connected to respective inputs of velocity selectors 366 and 368. Depending on the selected mode by mode switch 180, velocity selectors 366 and 368 supply signals from potentiometers 370 and 372, potentiometer 374 or potentiometer 376. Further, the torque limits can be set for both directions by potentiometers 378 and 380 associated with torque limit knobs 198 and 200.

The operation of apparatus 10 in the different modes will now be described with respect to the remainder of the circuitry, assuming all of the limits have been set, and starting with the concentric isokinetic mode of operation.

To begin, mode switch 180 is switched to the isokinetic mode. Accordingly, velocity selectors 366 and 368 are switched to supply the output signals from potentiometers 370 and 372, respectively. Then, START button 179 is depressed so as to supply a signal to logic circuit 382, the latter being supplied with the output signal from standby logic circuit 302 after ON button 178 has been depressed. Assuming that there is no defect in the operation of apparatus 10, logic circuit 382 thereby supplies a signal to set-up circuit 304 which, in turn, activates RUN relay 310. When mode switch is switched to this mode, apparatus 10 is automatically taken out of the set-up mode. As a result, RUN contact 336 is closed so that full power can be supplied to servo amplifier 334.

The user then starts applying a force to fixture 12 in the same direction that fixture 12 is to move. The applied force is measured by strain gauges 66, and is applied as a measured torque input to an inverter 384. Inverter 384 is controlled by mode switch 180, through line 386 connected to the eccentric mode position, to invert the polarity of the signal supplied thereto only when mode switch 180 is switched to the eccentric mode. At all other times, inverter 384 merely passes the signal through, as is, that is, without inverting the same. Therefore, in the concentric isokinetic mode, inverter 384 is inoperative, and the torque signal is supplied directly through to a velocity regulator 390. The set velocities selected by velocity selectors 366 and 368, that is, from potentiometers 370 and 372, are also supplied to velocity regulator 390. Enable logic circuit 360 also outputs a signal to velocity regulator 390 to enable the same, since mode switch 180 at such time is positioned at the concentric isokinetic position.

In response to these signals, velocity regulator 390 supplies a signal corresponding to the desired velocity, as determined by the torque applied to fixture 12, but which is not greater than the set or limiting velocity, to a ramp and multiplier circuit 400. Ramp and multiplier circuit 400 is enabled by enable logic circuit 360 and is activated by logic circuit 382 when START button 179 is depressed to apply a ramp function to the output signal from velocity regulator 390. This provides a slow start when apparatus 10 is first used, to ensure that the user will not be harmed.

The output signal from ramp and multiplier circuit 400, corresponding to the desired velocity, is then supplied through switch 364 to a velocity comparator 402, which is also supplied with a velocity signal from a speed sensing means, such as a tachometer, optical encoder, pulse pick-up or the like to be described later. In response to these signals, comparator 402 supplies an output signal corresponding to the difference therebetween, to a torque reference input of servo amplifier 334 to control servo motor 36 to maintain the desired velocity.

The deceleration operation will now be discussed. Since mode switch 180 is no longer in the set-up mode, switches 348 and 350 are opened, so that potentiometers 352 and 354 are no longer disabled. Accordingly, the same can be set to choose a percentage of the angular range of motion limits. Accordingly, the set limits from sample and hold circuits 338 and 340, as reduced, if at all, by potentiometers 352 and 354, are supplied to comparators 392 and 394, respectively. At the same time, the aforementioned velocity signal is supplied from apparatus 10 to one input of another comparator 396, and the actual position signal from position sensor 132 is supplied to the other input of comparator 396. In response to these signals, comparator 396 supplies an output signal corresponding to the change in velocity and position of fixture 12, to another input of each of comparators 392 and 394 which, in turn, supply output signals to velocity regulator 390 to vary the output signal therefrom. In effect, the outputs of comparators 392 and 394 control velocity regulator 390 to control the deceleration of fixture 12 at its angular limits. This is accomplished by comparing the actual speed and position of fixture 12 (from comparator 396) with the angular range of motion limits (from sample and hold circuits 338 and 340). Comparator 396 also has a potentiometer 398 connected across the velocity signal input and the output thereof.

The velocity signal and actual position signal are added in comparator 396. For example, the actual position signal may be 6 volts and the velocity signal may represent 3 volts. Therefore, the sum will be 9 volts corresponding to the stop position and comparator 396 will cause fixture 12 to start to slow down. The slowing down results in a reduction in a velocity signal, but since fixture 12 is still moved toward the limit, the position signal has changed, that is, the velocity signal equals 2.5 volts and the position signal equals 6.5 volts. This process continues until the velocity is zero and the position signal is at the set point of 9 volts. Thus, fixture 12 will accurately stop at the limit regardless of the velocity. With this arrangement, there is no overshooting of fixture 12 past the limit position. In order to provide for a cushioning effect, potentiometer 398 is adjusted to change the effect of velocity on the circuit. For example, to obtain a harder stop, the effect of the velocity may be reduced, causing it to slow down adjacent the stop at a later time.

Although comparators 392 and 394 and velocity regulator 390 slow down fixture 12 as it approaches its limits, such circuitry may not provide an absolutely correct stop at each limit. In order to achieve this, additional circuitry is provided, as will now be discussed. Specifically, the actual position signal from position sensor 132 is supplied to one input of a first comparator 404 and to one input of a second comparator 406. The other inputs of comparators 404 and 406 are supplied with signals from sample and hold circuits 338 and 340, respectively, corresponding to the preset angular limits. Therefore, comparators 404 and 406 provide output signals corresponding to the deviation of fixture 12 from its respective angular range of motion limits.

These deviation signals from comparators 404 and 406 are each supplied to an input of a respective gate 408 and 410. The other input of gates 408 and 410 is supplied with an output signal from a torque sensing circuit 412. Torque sensing circuit 412 is supplied with a torque signal from strain gauges 66, and determines the direction that torque is being applied to fixture 12. Thus, torque sensing circuit 412 activates only one gate 408 or 410, depending on the direction of movement of fixture 12, and thereby, on the angular limit that is being used.

The output signals from gates 408 and 410 are supplied to respective inputs of a further gate 414, which disables velocity regulator 390 when fixture 12 is at one of its angular limits. This provides a positive stop of fixture 12 at that limit. It will be appreciated that this will not result in a sudden impact stop of fixture 12, since fixture 12 is moving at a very slow speed at its limit, in view of the cushioning operation described above. In addition, the output of gate 414 is supplied to extension disable and flexion disable inputs of servo amplifier 334. Thus, when any of these outputs are zero, servo amplifier also controls servo motor 36 to positively stop at that point.

With the above in mind, it will be appreciated that the present invention provides a novel arrangement, whereby servo motor 36 drives fixture 12 in both directions in accordance with the force applied by the user and in the direction of the force applied by the user, in the concentric isokinetic mode of operation. Further, there is a soft start operation to prevent harm to the user when first using the apparatus. Also, there is an accurate and adjustable cushioning effect, and the fixture is caused to stop precisely at its angular limits. Of extreme importance is the fact that the angular limits can be set with the user in the apparatus, so that a trial and error method is unnecessary, that is, the first setting is the final setting of the angular limits. This is accomplished by the mere pressing of two buttons, one for each limit. If it is desired to reduce the limits, this can be performed by potentiometers 352 and 354, while retaining the 100% limits in sample and hold circuits 338 and 340 for future use.

In the eccentric isokinetic mode of operation, the operation is similar to that in the concentric isokinetic mode, with the difference being that servo motor 36 drives fixture 12 in both directions opposite to the direction of force applied by the user. Thus, when mode switch 180 is switched to the eccentric position, inverter 384 is activated to invert the torque signal supplied thereto. In this regard, fixture 12 is driven in a direction opposite to the direction of force applied by the user. Also, velocity selectors 366 and 368 select the velocity set by potentiometer 376. Generally, this velocity is much less than that used in the concentric isokinetic mode, since the direction of force applied by the user is opposite to that in which the fixture is driven.

Further, in the eccentric mode, fixture 12 is driven only after a threshold torque is applied thereto. In this regard, the output signals from potentiometers 378 and 380, which are set according to the maximum permissible torques, are supplied to a torque threshold circuit 414, along with the torque signal from strain gauges 66. This latter circuit produces an output signal when the applied torque is equal to or greater than a minimum threshold torque corresponding to a percentage of the maximum permissible torque, for example, on the order of 10% thereof. The output signal from torque threshold circuit 414 is supplied to a gate 417, along with a signal from mode switch 180 when the latter is switched to the eccentric mode. In response to these signals, gate 417 supplies a signal to enable logic circuit 360 which closes switch 364 only when the applied torque is equal to or greater than the threshold torque. It will be noted that this mode is somewhat different than the other modes, since enable logic circuit 360 is not only activated in response to the switching of mode switch 180 to the eccentric position. As soon as the threshold torque is applied, there is a ramp up of the speed, due to ramp and multiplier circuit 400, to full speed.

Further, in the eccentric mode, it can be dangerous if the speed is initially set greater than 60 degrees/second. Accordingly, at such time, HIGH SPEED ENABLE button 196 is caused to blink, and the operation cannot proceed until the user checks the speed settings and then pushes both the START button 179 and the HIGH SPEED ENABLE button 196. Specifically, at such time, logic circuit 382 is supplied with a signal from a high speed enable circuit 418 connected to the outputs of velocity selectors 366 and 368, when the velocity set in the eccentric mode is greater than 60 degrees/-second. Accordingly, logic circuit 382 prevents movement of fixture 12. After the set speed is reduced below 60 degrees/second, or if the user still wants to use such a high speed, the user depresses HIGH SPEED ENABLE button 196 and START button 179, both of which are connected to logic circuit 382, thereby permitting movement of fixture 12 at the set speed.

In the passive mode, servo motor 36 causes fixture 12 to oscillate at a predetermined velocity set by potentiometer 374. Accordingly, velocity selectors 366 and 368 supply the output signal from potentiometer 374 to velocity regulator 390. As in the eccentric mode, it can be dangerous if the speed is initially set greater than 60 degrees/second. Accordingly, at such time, HIGH SPEED ENABLE button 196 is caused to blink, and the operation cannot proceed until the user checks the speed settings and then pushes both the START button 179 and the HIGH SPEED ENABLE button 196.

In the passive mode, mode switch 180 supplies a signal to ramp and multiplier circuit 400 to control the latter to use a softer ramp, that is, a ramp having a lower slope. Thus, ramping up to full speed occurs over a number of, for example, three, cycles. This is because the speed of fixture 12 is not dependent upon the force applied by the user, but rather, is controlled by the setting of potentiometer 374. The same signal from the mode switch 180 is also supplied to enable logic circuit 360, the latter closing switch 364 when mode switch 180 is at the passive mode position.

As discussed above, it is important in the passive mode that the torque applied to fixture 12 also be controlled. This is because fixture 12 is not caused to move in response to a force applied by the user. Thus, there is the possibility that the user can be injured during the operation. Accordingly, the torque limits set by potentiometers 378 and 380 are also input to a torque limit circuit 420 which supplies an output signal to ramp and multiplier circuit 400 so that the output therefrom can not exceed the preset maximum torque limits set by potentiometers 378 and 380.

In order to determine when to change the direction of fixture 12 in the passive mode, the outputs of comparators 404 and 406 are also supplied to a passive direction circuit 422. When fixture 12 reaches either of its limits, the output signal from either comparator 404 or 406 indicates the next change of direction, and flips over the output from passive direction circuit 422. The output from passive direction circuit 422 is supplied to velocity regulator 390 to control the latter to change the direction or polarity of the output signal therefrom, so to cause fixture 12 to move in the opposite direction. Passive direction circuit 422 includes a pause circuit 424 which provides a pause in the signal supplied to velocity regulator 390 so that fixture 12 is caused to pause at its limit before moving in the opposite direction, dependent upon the amount of pause ordered by pause circuit 424. The amount of pause is variable by means of a potentiometer 426 connected with pause circuit 424. Potentiometer 424 is, in turn, controlled by the aforementioned pause control knob 222 on control panel 168.

Accordingly, servo motor 36 moves fixture 12 in both directions, at an angular speed determined by potentiometer 374 and with a pause at the angular limits as determined by potentiometer 426. Of course, servo motor 36 is still responsive to the torque signal from strain gauges 66 and the velocity signal, since velocity comparator 402 and velocity regulator 390 are still operative.

The last mode of operation is the isometric mode. When mode switch 180 is switched to this mode, mode switch 180 supplies a "0" velocity signal to enable logic circuit 360, which opens switch 364 to obtain zero speed of fixture 12 for all forces applied thereto.

In addition to the above control circuitry, apparatus 10 includes additional safety circuitry. Before discussing this safety circuitry in detail, the effect of such safety circuitry on the control circuitry of FIG. 11 will be discussed.

Basically, there are two types of system shut-downs that will occur. The first is a stop shut-down, that is, when there is a change or drift in the range of motion limits, when the user has pressed a comfort stop button, when there is an under voltage, when there is a position loss and when there is a strain gauge loss. In such case, the respective indicator light 234, 236, 238, 240 or 242 lights up, along with indicator light 244. At the same time, STOP button 228 on control panel 168 is caused to repeatedly blink by means of a blinker circuit 425. When this occurs, fixture 12 is controlled to go to zero speed by means of the residual power in a capacitor (not shown) in servo amplifier 334.

Specifically, the safety circuit supplies a signal along line 426 to logic circuit 382 of the control circuit of FIG. 11. Logic circuit 382, in turn, supplies a signal to ramp and multiplier circuit 400 to disable the same. As a result, the respective input to comparator 402 sees a zero value, and thereby produces an output signal to servo amplifier 334 that tends to drive fixture 12 to a zero velocity. At the same time, logic circuit 382 causes the RUN relay 310 to drop out, opening contact 336. As a result, there is a break in the high power near the secondary of isolation transformer 318. It is noted that, at this time, since apparatus 10 is not in the set-up mode, the set-up relay 328 has previously been dropped out. Therefore, all power to servo amplifier 334 is interrupted. However, although the input power to servo amplifier 334 is dropped out, there is still sufficient stored power in a capacitor in servo amplifier 334 to control movement of fixture 12 in response to the output signal from comparator 402. As a result, servo motor 36 drives fixture 12 to zero velocity.

In order to restart apparatus 10, STOP button 228 must be depressed, which supplies a reset signal to logic circuit 382. In such case, logic circuit 382 supplies an appropriate signal to set-up circuit 304 to reset the same, and enable it for resetting the limits once mode switch 180 is switched to the set-up mode. Once the limits are reset, operation can begin once again by depressing START button 179, and the operation follows in accordance with the aforementioned description.

In the event of a more serious fault, an emergency stop situation occurs. In such case, one or more of indicator lights 246, 248, 250, 252 and 254 light up, along with indicator light 256. These correspond to a set-up current greater than a preset amount, a power loss, an overspeed condition, exceeding of the angular range of motion limits and tachometer loss. At the same time, the safety circuit supplies a signal to a blinker circuit 428, which causes STANDBY button 226 to repeatedly blink.

This same signal is also supplied along a line 430 to an E STOP input of standby logic circuit 302 which, in turn, supplies a signal to logic circuit 382. In response thereto, logic circuit 382 disables ramp and multiplier circuit 400. Also, RUN relay 310 is dropped out, thereby terminating power to servo amplifier 334. With these fault conditions, however, it may not be possible to accurately control servo motor 36 to drive it to zero speed by the output of comparator 402. This is the case, for example, where there is a tachometer loss, whereby there is no way to detect the angular speed of fixture 12. Therefore, at such time, the signal from line 430 is also supplied to a DISABLE input of servo amplifier 334 to disable the same.

In such case, a signal is supplied from the safety circuit along line 432 to activate the dynamic brake (DB) relay 330. As a result, a dynamic brake contact DB connects a dynamic brake resistor 434 across servo motor 36. In effect, due to spinning of servo motor 36, servo motor 36 functions as a generator, and supplies current to resistor 434, thereby placing a load across servo motor 36, causing the same to stop.

In order to reset apparatus 10 in the emergency stop situation, STANDBY button 226 must first be depressed, thereby supplying a reset signal to standby logic circuit 302, followed by depression of ON button 178, which also supplies a signal to standby logic circuit 302. In response to these signals, standby logic circuit 302 supplies a signal to set-up circuit 204 and to logic circuit 382 to reset the case. After the limits have once again been reset, operation can resume by depressing START button 179.

The detailed circuit wiring diagram for the block diagram of FIG. 11 is shown in FIGS. 12A–12D.

Referring now to FIG. 13, there is shown a block diagram of the safety circuit 500 according to the present invention. As shown, a separate power supply 501 supplies power to strain gauges 68. It is noted that adjustments to strain gauges 66 are made in apparatus 10 itself by means of a coarse bias potentiometer 502 and a fine bias potentiometer 504. Basically, the coarse bias is factory set at zero for each gauge 66, and the fine bias is adjusted by means of sensitivity knob 224 on control panel 168. Accordingly, any strain gauges 66 can be used with any control circuit 300 by adjusting potentiometers 502 and 504. The output of strain gauges 66 is supplied through an amplifier 506 which applies a fixed amplification thereto so that the output is in the range of +10 V and −10 V, and then through a variable gain amplifier 508 having its gain factory calibrated, for example, 1.11 V at 50 foot-pounds. The output signal from amplifier 508 constitutes the torque output signal which is supplied as an input to inverter 384, torque sensing circuit 412, torque threshold circuit 414 and torque limit circuit 420 of control circuit 300.

Figure 14A:
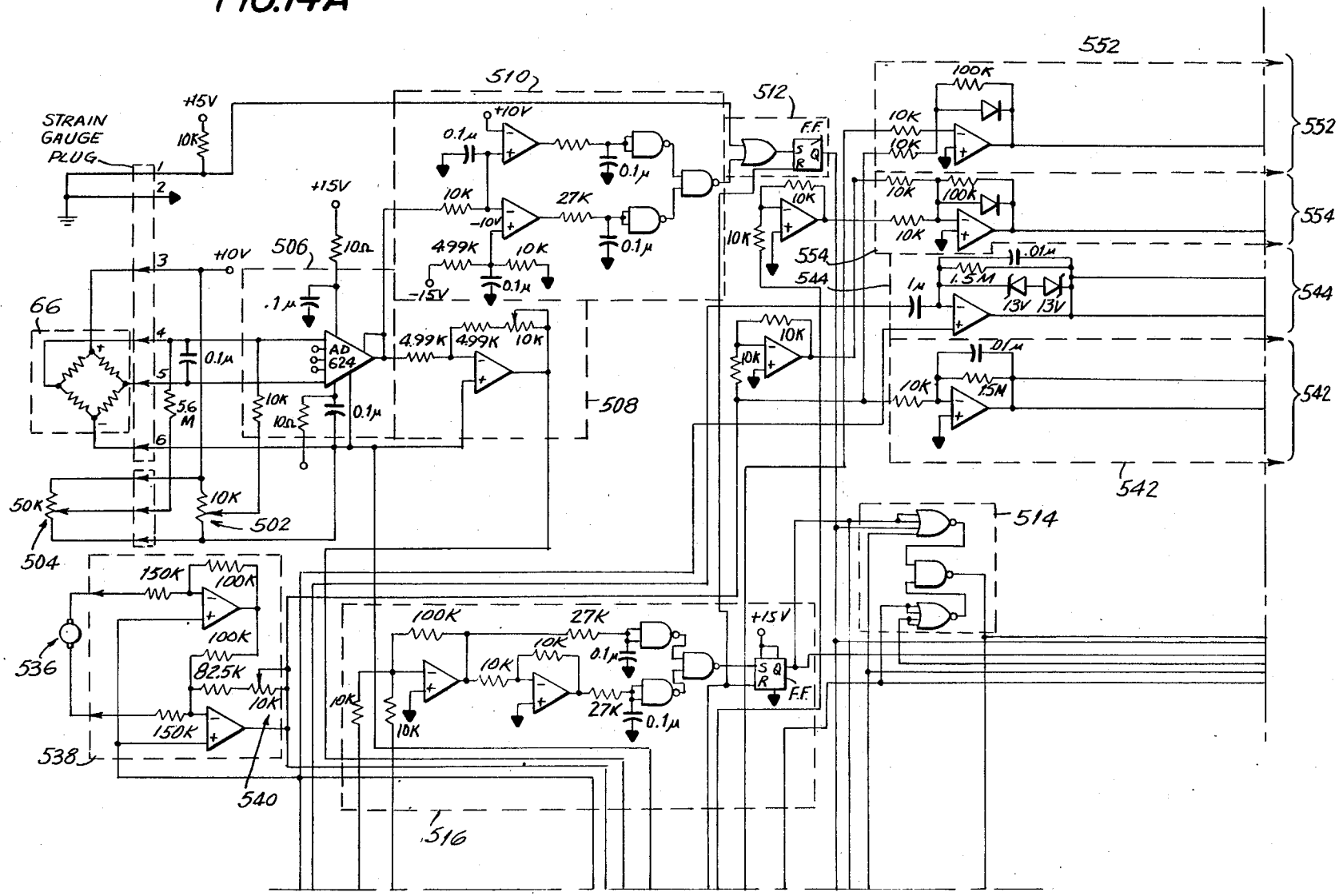
FIGS. 14A–14D constitute a detailed wiring diagram of the safety circuit of FIG. 13.
Figure 14B:
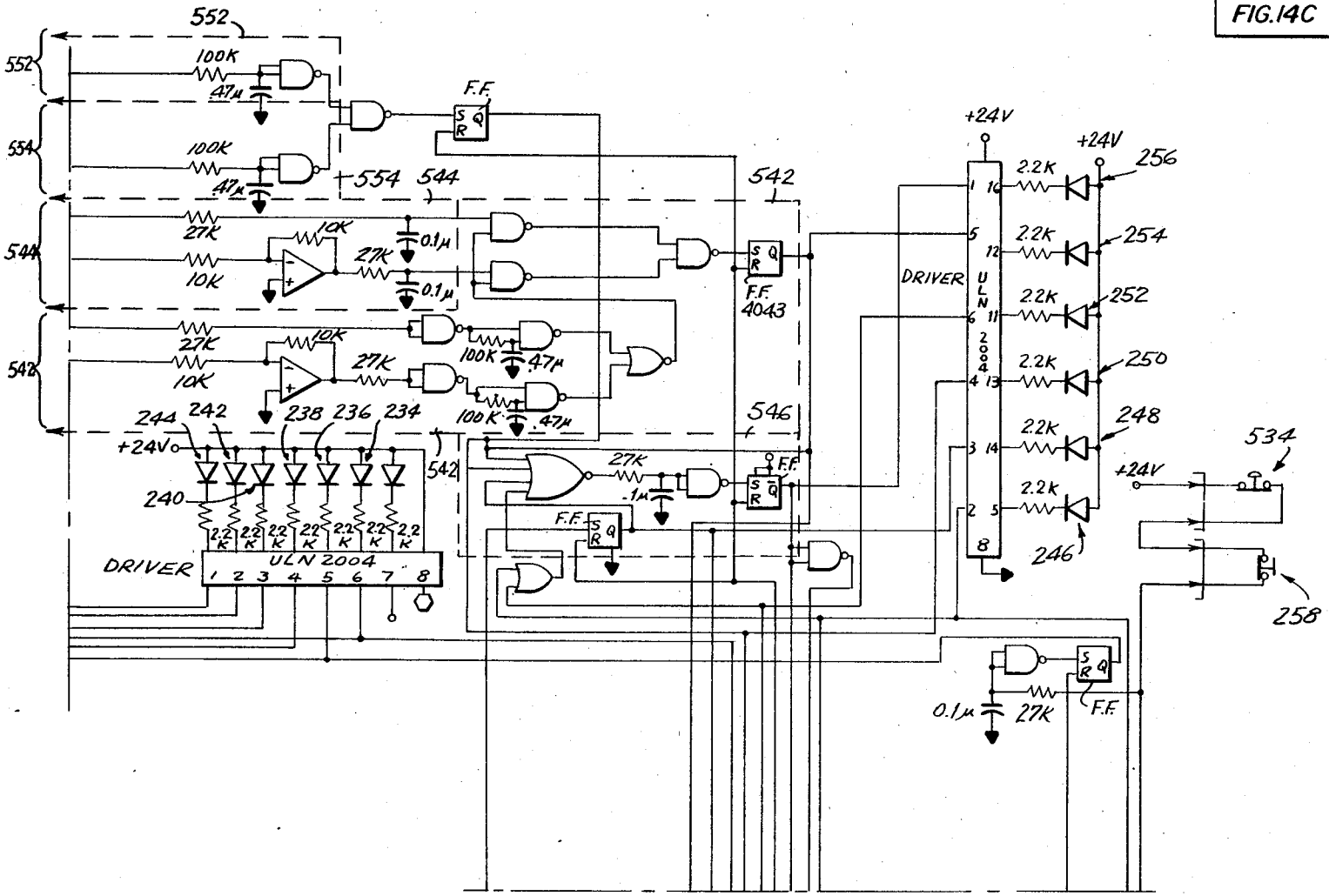
Figure 14C:
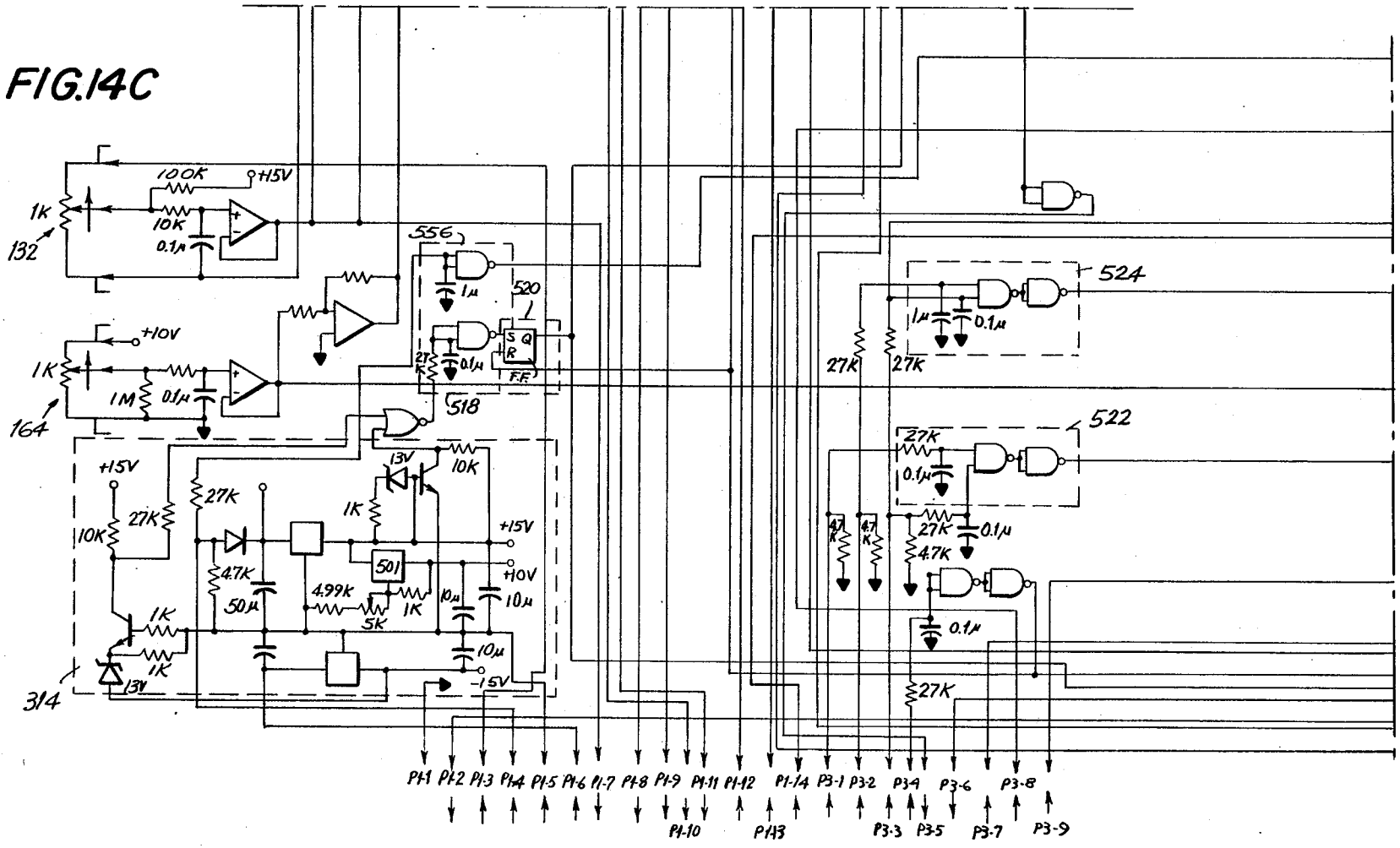

The output from amplifier 506 is also supplied to an input of a gauge fault detector 510, which is also supplied with preset limits, corresponding to maximum values that the output signal from amplifier 506 can attain. Since amplifier has set the range of the output signal therefrom between +10 V and −10 V, the preset limits supplied to gauge fault detector 510 should also be within this range. If not, gauge fault detector 510 supplies an error output signal to an OR gate 512. For example, if fixture 12 or gauges 66 become disconnected or break, gauge fault detector 510 would supply an error signal to OR gate 512. On the other hand, if the plug, and particularly, pins 1 and 2 thereof which are shown in the detailed wiring diagram of FIG. 14A, become disconnected, an error signal is supplied to another input of OR gate 512. In response to either error signal, OR gate 512 lights up indicator light 242, indicating a loss of strain gauge. This signal is also supplied to a stop circuit 514, which lights up indicator light 244, and which, in turn, supplies a signal to logic circuit 382 of control circuit 300 to halt operation of apparatus 10, as aforementioned.

As previously discussed, there are redundant position sensors 132 and 164. As discussed above, position sensor 132 is used with control circuit 300 to provide a position signal thereto for use in various operations. Each of position sensors 132 and 164 is supplied with power from a different power supply. Thus, position sensor 132 is supplied with power from power supply 314, while position sensor 164 is supplied with power from power supply 501, thereby absolutely making such position sensors 132 and 164 independent of each other.

The output signals from position sensor 132 and 164 are supplied to respective inputs of a comparator 516, which compares such signals. The output from comparator 516 corresponds to a deviation between the two measured positions. Ideally, the output from comparator 516 should be zero. However, if a potentiometer of a position sensor breaks, fixture 12 breaks, a gear 124 or 156 breaks or the like, the output signals from position sensors 132 and 164 may not be equal. In such case, comparator 516 causes indicator light 240 to light up, indicating that there is a position loss. In addition, the output signal from comparator 516 is supplied to stop circuit 514, which causes indicator light 244 to light up, and which also supplies a signal to logic circuit 382 of control circuit 300.

If the voltage produced by power supply 314 of control circuit 300 is below a certain voltage, apparatus 10 will not function correctly. Accordingly, the voltage, for example, 15 V, from power supply 314 is supplied to one input of an under voltage comparator 518, and the other input of comparator 518 is supplied with a reference voltage, for example, 13 V from a Zener diode. The output from comparator 518 is supplied to a switch circuit 520 in the form of a flip-flop circuit. Switch circuit 520 causes indicator light 238 to light up when an undervoltage, that is, lower than 13 V, is detected. In addition, the output signal from switch circuit 520 is supplied to stop circuit 514, which causes indicator light 244 to light up, and which also supplies a signal to logic circuit 382 of control circuit 300.

In order to ensure that apparatus 10 does not erroneously set the angular range of motion limits, which could cause harm to the user, a redundant circuit is provided which stores the angular range of motion limits, but based on the angular positions as measured by redundant position sensor 164. In particular, when in the set-up mode, a signal from mode switch 180 is supplied to respective inputs of gates 522 and 524. Gate 522 is enabled when the other input thereof is supplied with a signal from flexion LIMIT button 214, and in response thereto, enables a first sample and hold circuit 526 to sample the position signal from redundant position sensor 164. In like manner, gate 524 is enabled when the other input thereof is supplied with a signal from extension LIMIT button 212, and in response thereto, enables a second sample and hold circuit 528 to sample the position signal from redundant position sensor 164.

The stored extension position signal from sample and hold circuit 528, which is based on the output from position sensor 164, and the stored extension position signal from sample and hold circuit 338, which is based on the output from position sensor 132, are then compared in a comparator 530. If the output from comparator 530 is sufficiently large, it causes indicator light 234 to light up, thereby indicating a change in the range of motion. At the same time, the output from comparator 520 is supplied to stop circuit 514, which causes indicator light 244 to light up, and which also supplies a signal to logic circuit 382 of control circuit 300.

In like manner, the stored flexion position signal from sample and hold circuit 526, which is based on the output from position sensor 164, and the stored flexion position signal from sample and hold circuit 340, which is based on the output from position sensor 132, are then compared in a comparator 532. If the output from comparator 532 is sufficiently large, it causes indicator light 234 to light up, thereby indicating a change in the range of motion. At the same time, the output from comparator 532 is supplied to stop circuit 514, which causes indicator light 244 to light up, and which also supplies a signal to logic circuit 382 of control circuit 300.

As discussed above, if the user needs to stop apparatus 10 for any reason, he can do so by depressing a first comfort stop button 258 on apparatus 10, or by depressing a second comfort stop button 534 which is hand held and connected to jack 262 on indicator panel 230. These buttons 258 and 534 are electrically connected in series between a 24 V supply voltage and indicator light 236. Thus, if either of buttons 258 or 534 are depressed, indicator light 236 is caused to light up. At the same time, a signal is supplied to stop circuit 514, which causes indicator light 244 to light up, and which also supplies a signal to logic circuit 382 of control circuit 300. Further, these signals are supplied to control circuit 300 to drop out RUN relay 310.

The above operations of safety circuit 500 control stopping of apparatus 10, in which the residual power in a capacitor in servo amplifier 334 causes fixture 12 to go to zero speed. For more serious failures, however, it is necessary to disconnect servo amplifier 334 and activate a dynamic brake to stop fixture 12, as aforementioned. These more serious failures will now be discussed in greater detail.

A speed sensor 536, such as a tachometer, optical encoder, pick-up or the like, supplies the aforementioned velocity signal corresponding to the angular velocity of fixture 12, to an amplifier 538, which calibrates speed sensor 536 by means of a potentiometer 540. The output velocity signal from amplifier 538 is supplied to comparators 396 and 402 of control circuit 300, as discussed above.

This velocity signal is also supplied to one input of a comparator 542. At the same time, the position signal from position sensor 132 is supplied to a rate circuit 544, which determines the rate of change of the position of fixture 12, that is, the angular velocity of fixture 12, based on the position signal from position sensor 132. The output signal from rate circuit 544 is supplied to another input of comparator 542. Ideally, the two signals supplied to comparator 542 should be equal. However, if there is a fault in the circuitry, such that the signals are not equal, comparator 542 will cause indicator light 254 to light up, indicating a tachometer loss. This may occur, for example, when there is a change in position, with no output from speed sensor 536.

At the same time, comparator 542 supplies a signal to an emergency stop circuit 546, which causes indicator light 256 to light up, and which also supplies a signal to the E stop input of standby logic circuit 302 of control circuit 300 and to the disable input of servo amplifier 334. As discussed more fully above, this signal terminates operation of servo amplifier 334 and stops operation of apparatus 10. In order to stop movement of fixture 12, the dynamic brake is thereby set.

As discussed above, it is necessary to detect if fixture 12 exceeds the angular range of motion limits, to prevent possible harm to the user. In this regard, the flex limit stored in sample and hold circuit 526 is supplied to one input of a comparator 548 and the position signal from position sensor 164 is supplied to the other input of comparator 548. If the position of fixture 12 exceeds the set limit, comparator 548 causes indicator light 252 to light up, indicating that the position of fixture 12 is over the range of motion limits. At the same time, comparator 548 supplies a signal to emergency stop circuit 546, which causes indicator light 256 to light up, and which also supplies a signal to the E stop input of standby logic circuit 302 of control circuit 300 and to the disable input of servo amplifier 334.

In like manner, the extension limit stored in sample and hold circuit 528 is supplied to one input of a comparator 550 and the position signal from position sensor 164 is supplied to the other input of comparator 550. If the position of fixture 12 exceeds the set limit, comparator 550 causes indicator light 252 to light up, indicating that the position of fixture 12 is over the range of motion limits. At the same time, comparator 550 supplies a signal to emergency stop circuit 546, which causes indicator light 256 to light up, and which also supplies a signal to the E stop input of standby logic circuit 302 of control circuit 300 and to the disable input of servo amplifier 334.

It is also necessary to detect if fixture 12 exceeds the angular velocities set by potentiometers 370, 372, 374 or 376, depending upon the mode of operation, to prevent possible harm to the user. In this regard, the maximum extension velocity from velocity selector 366 is supplied to one input of a comparator 552 and the velocity signal from amplifier 538 is supplied to the other input of comparator 552. If the angular velocity of fixture 12 exceeds the set limit, comparator 552 causes indicator light 250 to light up, indicating that the extension velocity of fixture 12 is over the maximum extension velocity. At the same time, comparator 552 supplies a signal to emergency stop circuit 546, which causes indicator light 256 to light up, and which also supplies a signal to the E stop input of standby logic circuit 302 of control circuit 300 and to the disable input of servo amplifier 334.

In like manner, the maximum flex velocity from velocity selector 368 is supplied to one input of a comparator 554 and the velocity signal from amplifier 538 is supplied to the other input of comparator 554. If the velocity of fixture 12 exceeds the set limit, comparator 554 causes indicator light 250 to light up, indicating that the velocity of fixture 12 is over the maximum flex velocity. At the same time, comparator 554 supplies a signal to emergency stop circuit 546, which causes indicator light 256 to light up, and which also supplies a signal to the E stop input of standby logic circuit 302 of control circuit 300 and to the disable input of servo amplifier 334.

If there is a power loss, there is no power to stop fixture 12. Thus, for example, if fixture 12 is near one of its limits, there is no power to prevent fixture 12 from exceeding such limit. Therefore, if there is a power loss, this is detected by a power loss circuit 556 connected to power supply 314, and power loss circuit 556 causes indicator light 248 to light up, indicating a power loss. At the same time, power loss circuit 556 supplies a signal to emergency stop circuit 546, which causes indicator light 256 to light up, and which also supplies a signal to the E stop input of standby logic circuit 302 of control circuit 300 and to the disable input of servo amplifier 334.

As previously discussed, in the set-up mode, there is a low set speed of, for example, 10% of the maximum speed, used with the motor control, thereby limiting the maximum speed of fixture 12 to a very low speed. In this regard, in the set-up mode, mode switch 180 supplies a signal to a comparator 558 to enable the same. Also, the current supplied to servo amplifier 334 from isolation transformer 318 is supplied to comparator 558, which compares this current to a preset current corresponding to 20% of the maximum current level. If the current from isolation transformer 318 exceeds the preset current level, comparator 558 causes indicator light 246 to light up. At the same time, comparator 558 supplies a signal to emergency stop circuit 546, which causes indicator light 256 to light up, and which also supplies a signal to the E stop input of standby logic circuit 302 of control circuit 300 and to the disable input of servo amplifier 334.

Lastly, it is important to detect whether fixture 12 is positioned correctly on the apparatus. In this regard, a normally open switch 560 can be positioned on shaft 14, and when an fixture 12 is correctly positioned on shaft 14, switch 560 is closed. When open, switch 560 can cause another indicator light 249 (not shown in FIG. 10) to light up, while also supplying a signal to emergency stop circuit 546 to actuate the same as aforementioned.

Figure 14D:
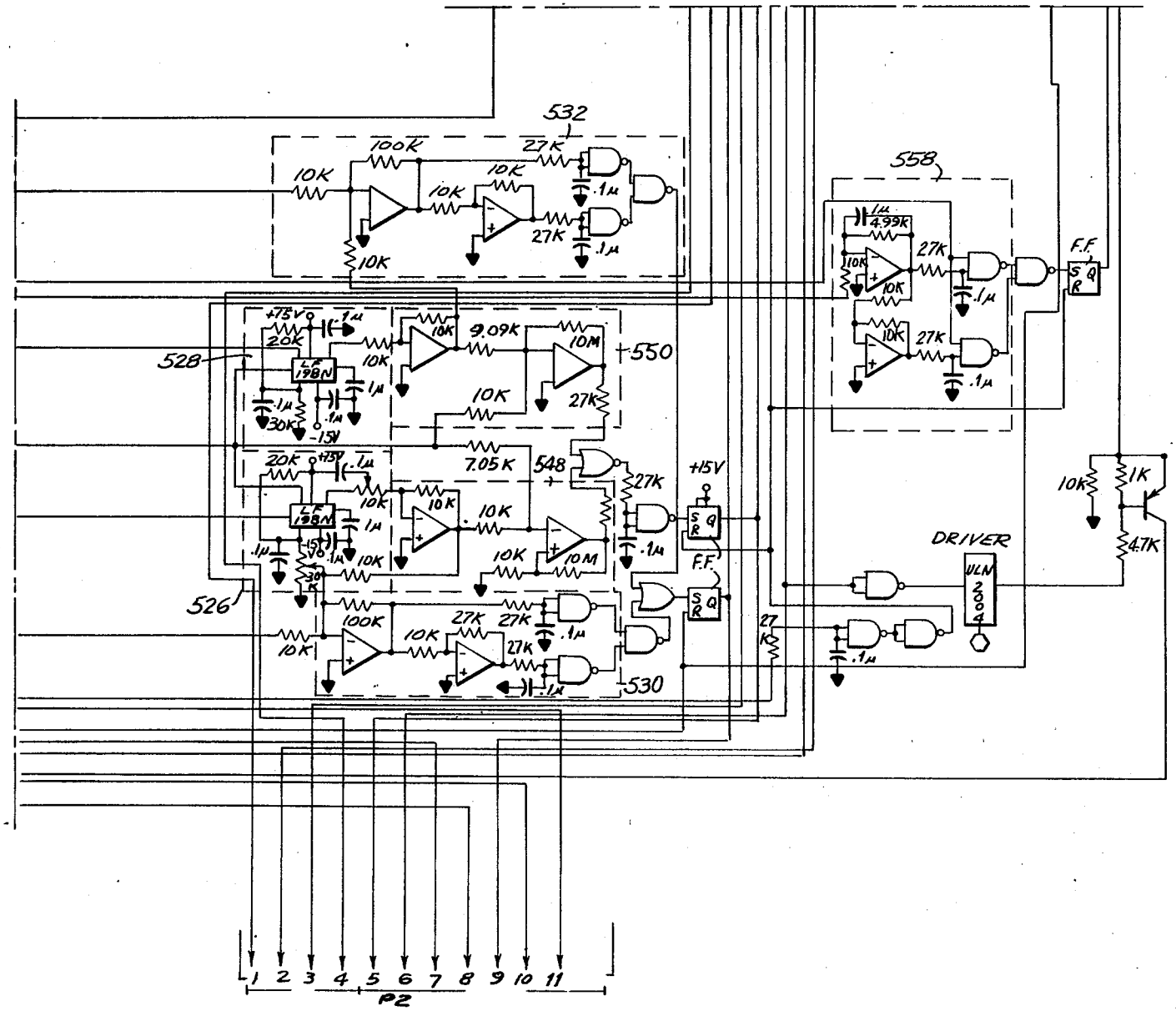

The detailed circuit wiring diagram for safety circuit 500 is shown in FIGS. 14–14D.

Thus, with the present invention, there is provided a muscle exercise and rehabilitation apparatus 10 in which fixture 12 is moved at all times by servo motor 36 in response to the sensed velocity of fixture 12 and the force applied thereto. Further distinct advantages are also achieved, for example, the angular range of motion of fixture 12 can be easily and readily set by having the user extend his limb to the desired limit and merely depressing buttons 212 and 214. Also, with respect to deceleration of fixture 12 near its limits, there is provided a gentle cushioning effect and fixture 12 is controlled to stop precisely at its set limits. Further, the strain gauges are mounted on shaft 14, rather than on fixture 12, to provide easy and ready interchangeability of different fixtures. In this regard, external wires connected to strain gauges 66 are connected in a novel manner so as not to interfere with operation of the machine, even when the machine is used in different angular orientations. Also, mounting of strain gauges 66 on shaft 14 substantially eliminates the effect of different length fixtures on the strain gauges.

With the present invention, there is the additional advantage that vibration between connections of various mechanical elements is decreased, such as between fixture 12 and shaft 14 and between the connection of gear box 34 to servo motor 36. As a result, there is a substantial reduction in backlash, whereby such backlash is not servoed through the system. Related thereto, the sensitivity of the apparatus is increased.

It is a further important feature of the present invention to provide numerous safety features to protect the user from injury, and to provide visual diagnostic indicators which indicate the exact point of failure of the machine. Further, the circuits of FIGS. 12 and 14 provide outputs at terminals P2-(#) (FIG. 14) and terminals P4-(#) and P5-(#) (FIG. 12) that are supplied to external components, such as computer 170, whereby a diagnosis can be made.

It will be appreciated that, although the use of the terms flexion and extension have been used repeatedly throughout the application to describe the present invention, the present invention is not limited thereby and any other movements of different body parts may be performed. Accordingly, flexion and extension have been used as short hand terms for movement in a first direction and movement in a second direction.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined in the appended claims.

What is claimed is:

1. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

limit means for preventing movement of said fixture means past at least one set limit;

storage means for storing a limit signal corresponding to each said limit; and limit setting means for enabling said storage means to store the respective limit upon movement of said fixture means to each said limit.

2. A muscle exercise and rehabilitation apparatus according to claim 1; further including position sensing means for producing a position signal corresponding to the position of said fixture means; and wherein said storage means stores said position signal as said limit signal, upon enablement by said limit setting means.

3. A muscle exercise and rehabilitation apparatus according to claim 2; wherein said limit means prevents movement of said fixture means past a first limit in a first direction and a second limit in a second, opposite direction; and said storage means includes a first sample and hold circuit for storing said position signal corresponding to said first limit and a second sample and hold circuit for storing said position signal corresponding to said second limit, upon enablement by said limit setting means.

4. A muscle exercise and rehabilitation apparatus according to claim 3; wherein said limit setting means includes first actuation means for enabling said first sample and hold circuit to store said position signal when said fixture means is moved to said first limit and second actuation means for enabling said second sample and hold circuit to store said position signal when said fixture means is moved to said second limit.

5. A muscle exercise and rehabilitation apparatus according to claim 4; further including mode switch means for setting a mode of operation of said apparatus, said mode switch means being movable to a set-up position, and wherein said first and second actuation means are enabled in response to movement of said mode switch means to said set-up position.

6. A muscle exercise and rehabilitation apparatus according to claim 2; wherein said storage means further includes limit reducing means for reducing the level of the position signal corresponding to each said limit stored in said storage means.

7. A muscle exercise and rehabilitation apparatus according to claim 6; wherein said limit reducing means includes potentiometer means connected to an output of said storage means.

8. A muscle exercise and rehabilitation apparatus according to claim 1; wherein said closed loop servo means includes servo amplifier means for controlling operation of said servo motor means; and further including set-up means for reducing current supplied to said servo amplifier means when setting said limits.

9. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

limit means for preventing movement of said fixture means past at least one set limit;

storage means for storing a limit signal corresponding to each said limit;

position sensing means for producing a position signal corresponding to the position of said fixture means; and deceleration means for slowing down movement of said fixture means as said fixture means approaches each said limit, in response to said velocity signal, said position signal and said limit signal.

10. A muscle exercise and rehabilitation apparatus according to claim 9; wherein said closed loop servo means includes servo amplifier means for controlling operation of said servo motor means, and said limit means includes position comparator means for comparing the limit signal corresponding to each limit stored in said storage means with the position signal from said position sensing means corresponding to the actual position of said fixture means, and for controlling said servo amplifier means to prevent movement of said fixture means past each said limit in response thereto.

11. A muscle exercise and rehabilitation apparatus according to claim 10; wherein said closed loop servo means includes velocity comparator means for comparing the velocity signal with said load signal and for controlling said servo amplifier means in response thereto; and said position comparator prevents said load signal being supplied to said velocity comparator means when said fixture means is moved to each said limit.

12. A muscle exercise and rehabilitation apparatus according to claim 9; wherein said closed loop servo means includes servo amplifier means for controlling operation of said servo motor means, velocity setting means for setting a maximum velocity of said fixture means in a first direction and a second, opposite direction, velocity comparator means for comparing the velocity signal with said load signal and for controlling said servo amplifier in response thereto, and velocity regulator means for regulating said load signal in response to said velocity setting means; and said deceleration means controls said velocity regulator means to slow down movement of said fixture means as said fixture means approaches each said limit.

13. A muscle exercise and rehabilitation apparatus according to claim 9; wherein said deceleration means includes first comparator means for producing an output signal in response to said velocity signal and said position signal, and second comparator means for comparing said output signal from said first comparator means with the limit signal stored in said storage means to produce a control signal which is supplied to said closed loop servo means to slow down movement of said fixture means as said fixture means approaches each said limit.

14. A muscle exercise and rehabilitation apparatus according to claim 13; wherein said storage means includes a first storage circuit for storing said position signal corresponding to a first limit as a first limit signal, and a second storage circuit for storing said position signal corresponding to a second limit as a second limit signal, upon enablement by said limit setting means, and said second comparator means includes a first comparator circuit for comparing said output signal with said first limit signal and supplying a first control signal in response thereto to said closed loop servo means to control the latter to slow down movement of said fixture means as said fixture means approaches said first limit and a second comparator circuit for comparing said output signal with said second limit signal and supplying a second control signal in response thereto to said closed loop velocity servo means to control the latter to slow down movement of said fixture means as said fixture means approaches said second limit.

15. A muscle exercise and rehabilitation apparatus according to claim 14; wherein said closed loop servo means includes servo amplifier means for controlling operation of said servo motor means, velocity setting means for setting a maximum velocity of said fixture means in a first direction and a second, opposite direction, velocity comparator means for comparing the velocity signal with said load signal and for controlling said servo amplifier means in response thereto, and velocity regulator means for regulating said load signal in response to said velocity setting means; and said first and second comparator circuits supply said first and second control signals to said velocity regulator means to control the latter to slow down movement of said fixture means as said fixture means approaches each said limit.

16. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means, said closed loop servo means including servo amplifier means for controlling operation of said servo motor means, velocity comparator means for comparing the velocity signal with said load signal and for controlling said servo amplifier in response thereto, and switch means for supplying said load signal to said velocity comparator means; and mode switch means for controlling said switch means in an isometric mode to prevent said load signal being supplied to said velocity comparator means, whereby said fixture means is prevented from moving.

17. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means to drive said fixture means in an oscillation mode at a constant velocity in response to said load signal and said velocity signal to regulate the velocity of said fixture means;

limit means for preventing movement of said fixture means past set limits in opposite directions; and pause means for controlling said closed loop velocity servo feedback means to cause said fixture means to pause at each said limit for a predetermined amount of time.

18. A muscle exercise and rehabilitation apparatus according to claim 17; wherein said closed loop servo means includes servo amplifier means for controlling operation of said servo motor means, velocity comparator means for comparing the velocity signal with said load signal and for controlling said servo amplifier in response thereto, velocity setting means for setting a maximum velocity of said fixture means in a first direction and a second, opposite direction, velocity regulator means for regulating said load signal in response to said velocity setting means, and passive direction means for supplying a passive direction signal to said velocity regulator means to control the latter to change the polarity of said load signal supplied to said velocity comparator means when said fixture means reaches each said limit to enable said fixture means to move in an opposite direction; and said pause means delays supplying said passive direction signal to said velocity regulator means for a predetermined amount of time to cause said fixture means to pause at each said limit for said predetermined amount of time.

19. A muscle exercise and rehabilitation apparatus according to claim 17; wherein said pause means includes adjustment means for varying said predetermined amount of time.

20. A muscle exercise and rehabilitation apparatus according to claim 19; wherein said adjustment means includes a potentiometer.

21. A muscle exercise and rehabilitation apparatus comprising:

movable fixture means against which a force can be applied;

servo motor means having an output shaft coupled to the fixture means;

sensing means effectively coupled between said output shaft and said fixture means for sensing the force applied to the fixture means and for producing a load signal corresponding thereto;

speed detecting means for producing a velocity signal corresponding to the speed of the fixture means; and closed loop servo means for controlling said motor means in response to said load signal and said velocity signal to regulate the velocity of said fixture means.

22. A muscle exercise and rehabilitation apparatus according to claim 21; wherein said sensing means includes a sensing tube effectively coupled between said output shaft and said fixture means, and strain gauge means mounted on said sensing tube for sensing the force applied to the fixture means and for producing said load signal corresponding thereto.

23. A muscle exercise and rehabilitation apparatus according to claim 22; further including a rotatable shaft to which said fixture means is fixed, mounted in said apparatus, and a flange fixed to one end of said rotatable shaft; and wherein said sensing tube includes a central tube positioned on said rotatable shaft with said strain gauge means mounted on said central tube, a first flange fixed at one end of said central tube and rotatably fixed with said output shaft and a second flange fixed at an opposite end of said central tube and rotatably fixed with said flange on said rotatable shaft, to thereby effectively couple said sensing means between said output shaft and said fixture means.

24. A muscle exercise and rehabilitation apparatus according to claim 23; wherein said rotatable shaft is formed with a first section having a first diameter and a second section having a second larger diameter, with said second section being in abutting relation with a housing of said rotatable shaft to limit axial movement of said rotatable shaft; and said central tube is positioned around said second section to prevent undue axial tightening forces from being placed on said central shaft and the strain gauge means.

25. A muscle exercise and rehabilitation apparatus according to claim 22; further including wire means for supplying said load signal from said sensing means to said closed loop servo means, and take-up means for preventing entanglement of said wire means during movement of said fixture means.

26. A muscle exercise and rehabilitation apparatus according to claim 25; wherein said take-up means includes drive gear means mounted for rotation with said sensing tube, driven gear means in meshing engagement with said drive gear means, and a first pulley rotatably fixed with said driven gear means, with said wire means being wrapped about said sensing tube and said first pulley for preventing entanglement of said wire means during movement of said fixture means.

27. A muscle exercise and rehabilitation apparatus according to claim 26; wherein said take-up means further includes a second pulley mounted on said sensing tube for rotation therewith and rotatably fixed with said drive gear, said wire means from said strain gauge means being wrapped about said second pulley and then about said first pulley; said first pulley and said driven gear being mounted on a rotatable shaft; and said first pulley having an aperture through which said wire means extends from said first pulley and is wrapped about said rotatable shaft.

28. A muscle exercise and rehabilitation apparatus according to claim 26; further including position detecting means for producing a position signal corresponding to the position of said fixture means, said position sensing means including a position gear in meshing engagement with said drive gear, and position sensor means connected with said position gear for determining the position of said fixture means.

29. A muscle exercise and rehabilitation apparatus according to claim 22; further including a rotatable shaft to which said fixture means is fixed, mounted in said apparatus, said rotatable shaft including a flange fixed to one end thereof and at least one end thereof being tapered and having first securing means thereat; and wherein said sensing tube is positioned on said rotatable shaft and rotatably fixed with said flange and said output shaft, to thereby effectively coupled said sensing means between said output shaft and said fixture means, and said fixture means includes a tapered bore having at least one flat surface through which each mating tapered end of said rotatable shaft can extend; and further including second securing means for engaging with said first securing means when said fixture means is positioned on said rotatable shaft to fixedly retain said fixture means on said rotatable shaft in a wedge-like manner so as to substantially reduce backlash.

30. A muscle exercise and rehabilitation apparatus according to claim 29; wherein said first securing means includes a screw-threaded bore in at least one end of said rotatable shaft; and said second securing means includes bolt means engageable with an end face of said fixture means and adapted to be screw-threadedly engaged in one said screw-threaded bore.

31. A muscle exercise and rehabilitation apparatus according to claim 22; further including plate means rotatably fixed with said output shaft, said plate means including a projection, and stop means mounted to said apparatus and engageable with said projection to prevent rotation of said output shaft more than 360 degrees.

32. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

detection means for detecting at least one predetermined operational fault of said apparatus;

emergency stop means for terminating operation of said apparatus upon detection of at least one said operation fault; and brake means for braking said servo motor means to stop movement of said fixture means in response to said emergency stop means.

33. A muscle exercise and rehabilitation apparatus according to claim 32; further including position sensing means for producing a position signal corresponding to the position of said fixture means; and wherein said detection means includes speed detecting loss means for detecting an operational fault of said speed detecting means, said speed detecting loss means including rate means for producing a speed signal in response to the rate of change of said position signal, and comparator means for comparing said speed signal and said velocity signal and for supplying an error signal to said emergency stop means when said speed signal and said velocity signal differ by a predetermined amount.

34. A muscle exercise and rehabilitation apparatus according to claim 32; further including limit means for preventing movement of said fixture means past at least one set limit; and wherein said detection means includes over limit means for detecting when said fixture means has moved past said at least one set limit and for supplying an error signal to said emergency stop means in response thereto.

35. A muscle exercise and rehabilitation apparatus according to claim 34; further including position sensing means for producing a position signal corresponding to the position of said fixture means, and storage means for storing a limit signal corresponding to each said limit; and wherein said over limit means includes comparator means for comparing said position signal with said limit signal and for supplying an error signal to said emergency stop means when said position signal is greater than said limit signal.

36. A muscle exercise and rehabilitation apparatus according to claim 32; further including velocity setting means for controlling said closed loop velocity servo feedback means to prevent movement of said fixture means greater than a preset maximum velocity; and wherein said detection means includes over speed sensing means for detecting if said fixture means is moving at a speed greater than said preset maximum velocity, in response to said velocity setting means and said speed detecting means, and for supplying an error signal to said emergency stop means when the speed of said fixture means is greater than said preset maximum velocity.

37. A muscle exercise and rehabilitation apparatus according to claim 32; wherein said detection means includes power loss means for detecting if there is a power loss from a power supply of said apparatus and for supplying an error signal to said emergency stop means when such a power loss is detected thereby.

38. A muscle exercise and rehabilitation apparatus according to claim 32; further including limit means for preventing movement of said fixture means past at least one set limit, actuation means for setting said at least one set limit, and mode switch means for setting a mode of operation of said apparatus, said mode switch means being movable to a set-up position to enable said actuation means for setting said at least one set limit, and set-up means for reducing current to said servo motor means when said mode switch means is moved to said set-up position; and wherein said detection means includes current detection means for detecting if said current supplied to said servo motor means during the set-up mode is greater than a predetermined value and for supplying an error signal to said emergency stop means in response thereto.

39. A muscle exercise and rehabilitation apparatus according to claim 32; wherein said emergency stop means shuts off all power to said servo motor means upon detection of at least one said operation fault.

40. A muscle exercise and rehabilitation apparatus according to claim 32; wherein said brake means includes resistive means connected across said servo motor means in response to a signal from said emergency stop means for braking said servo motor means to stop movement of said fixture means in response to said emergency stop means.

41. A muscle exercise and rehabilitation apparatus according to claim 32; further including indicator means for indicating when at least one predetermined operational fault of said apparatus is detected.

42. A muscle exercise and rehabilitation apparatus according to claim 41; wherein said indicator means includes an indicator light for each predetermined operational fault.

43. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

detection means for detecting at least one predetermined operational fault of said apparatus; and stop means for controlling said servo motor means to stop movement of said fixture means upon detection of at least one said operation fault.

44. A muscle exercise and rehabilitation apparatus according to claim 43, wherein said detection means includes load sensing loss means for detecting an operational fault of said sensing means and for supplying an error signal to said stop means in response thereto.

45. A muscle exercise and rehabilitation apparatus according to claim 43; further including first position sensing means for producing a first position signal corresponding to the position of said fixture means and second, redundant position sensing means for producing a second position signal corresponding to the position of said fixture means; and wherein said detection means includes position loss means for supplying an error signal to said stop means when said first and second position signals are not equal.

46. A muscle exercise and rehabilitation apparatus according to claim 43; wherein said detection means includes under voltage means for detecting if voltage from a power supply of said apparatus is less than a predetermined voltage, and for supplying an error signal to said stop means in response thereto.

47. A muscle exercise and rehabilitation apparatus according to claim 43; further including comfort stop actuation means; and said detection means includes means for supplying an error signal to said stop means upon actuation of said comfort stop actuation means.

48. An muscle exercise and rehabilitation apparatus according to claim 43; further including limit means for preventing movement of said fixture means past at least one set limit; and wherein said detection means includes change in limit means for detecting when said at least one set limit has changed by a predetermined amount and for supplying an error signal to said stop means in response thereto.

49. A muscle exercise and rehabilitation apparatus according to claim 48; further including first storage means for storing a first limit signal corresponding to each said limit and second, redundant storage means for storing a second limit signal corresponding to each said limit; and wherein said change in limit means includes comparator means for comparing first and second limit signals and for supplying an error signal to said stop means when said first and second limits signals differ by a predetermined amount.

50. A muscle exercise and rehabilitation apparatus according to claim 43; wherein said closed loop servo means includes servo amplifier means for controlling operation of said servo motor means, said servo amplifier means including at least one storage element for storing residual power, and said stop means shuts off all power to said servo motor means upon detection of at least one said operation fault, and controls said servo amplifier means to stop movement of said fixture means with said residual power.

51. A muscle exercise and rehabilitation apparatus according to claim 50; wherein said storage element includes at least one capacitive element.

52. A muscle evaluation and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

limit means for preventing movement of said fixture means past at least one set limit;

storage means for storing a limit signal corresponding to each said limit; and limit setting means for enabling said storage means to store the respective limit upon movement of said fixture means to each said limit.

53. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

a rotatable shaft to which said fixture means is fixed, mounted in said apparatus, at least one end of said rotatable shaft being tapered and having first securing means thereat;

said fixture means includes a wedge-shaped tapered bore through which each tapered end of said rotatable shaft can extend; and second securing means for engaging with said first securing means when said fixture means is positioned on one end of said rotatable shaft to fixedly retain said fixture means on said rotatable shaft in a wedge-like manner so as to substantially reduce backlash.

54. A muscle exercise and rehabilitation apparatus comprising:

movable fixture means against which a force can be applied;

servo motor means coupled to the fixture means;

sensing means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means;

at least one manually operated comfort stop actuator for stopping movement of said fixture means; and stop means for controlling said servo motor means to stop movement of said fixture means in response to said at least one manually operated comfort stop actuator.

55. A muscle exercise and rehabilitation apparatus according to claim 54; wherein there are two manually operated comfort stop actuators, one positioned on said apparatus and the other connected to said apparatus by electrical wires and adapted to be held by a user of said apparatus during operation of said apparatus.

56. A muscle exercise and rehabilitation apparatus comprising:

movable fixture means against which a force can be applied;

a rotatable shaft to which said fixture means is fixed, mounted in said apparatus, at least one end of said rotatable shaft being tapered and having first securing means thereat;

said fixture means includes a wedge-shaped tapered bore through which each tapered end of said rotatable shaft can extend;

second securing means for engaging with said first securing means when said fixture means is positioned on one end of said rotatable shaft to fixedly retain said fixture means on said rotatable shaft in a wedge-like manner so as to substantially reduce backlash;

servo motor means having an output shaft coupled to the fixture means;

sensing means effectively coupled between said output shaft and said fixture means for sensing the force applied to the fixture means and for producing a load signal corresponding thereto;

speed detecting means for producing a velocity signal corresponding to the speed of the fixture means;

closed loop servo means for controlling said motor means in response to said load signal and said velocity signal to regulate the velocity of said fixture means, said closed loop servo means including servo amplifier means for controlling operation of said servo motor means, velocity comparator means for comparing the velocity signal with said load signal and for controlling said servo amplifier in response thereto, and switch means for supplying said load signal to said velocity comparator means;

limit means for preventing movement of said fixture means past at least one set limit;

storage means for storing a limit signal corresponding to each said limit;

limit setting means for enabling said storage means to store the respective limit upon movement of said fixture means to each said limit;

position sensing means for producing a position signal corresponding to the position of said fixture means;

deceleration means for slowing down movement of said fixture means as said fixture means approaches each said limit, in response to said velocity signal, said position signal and said limit signal;

pause means for controlling said closed loop servo means to cause said fixture means to pause at each said limit for a predetermined amount of time;

mode switch means for controlling said switch means in an isometric mode to prevent said load signal being supplied to said velocity comparator means, whereby said fixture means is prevented from moving, regardless of the force applied thereto, an isokinetic mode in which said fixture means is caused to move with a regulated velocity and an oscillation mode in which said fixture means is caused to oscillate at a constant velocity;

detection means for detecting at least one predetermined operational fault of said apparatus;

at least one manually operated comfort stop actuator for stopping movement of said fixture means;

emergency stop means for terminating operation of said apparatus upon detection of at least one of a predetermined set of said operation faults;

brake means for braking said servo motor means to stop movement of said fixture means in response to said emergency stop means; and stop means for controlling said servo motor means to stop movement of said fixture means upon detection of at least one operation fault and in response to said comfort stop actuator.

* * * * *

Disclaimer 4,691,694.—*Robert L. Boyd*, Woodcliff Lake; *Richard Krukowski*, Chatham, both of N.J.; *Daniel Y. Gezaeri*, Chevy Chase, Md. MUSCLE EXERCISE AND REHABILITATION APPARATUS. Patent dated Sept. 8, 1987. Disclaimer filed Dec. 5, 1988, by the assignee, *Biodex Corp.*

Hereby enters this disclaimer to claims 16 and 53 of said patent.

[*Official Gazette March 7, 1989.*]